US010670296B2

(12) United States Patent
Popli et al.

(10) Patent No.: US 10,670,296 B2
(45) Date of Patent: Jun. 2, 2020

(54) SYSTEM AND METHOD OF ADJUSTING COMPRESSOR MODULATION RANGE BASED ON BALANCE POINT DETECTION OF THE CONDITIONED SPACE

(71) Applicant: Emerson Climate Technologies, Inc., Sidney, OH (US)

(72) Inventors: Sahil Popli, Silver Spring, MD (US); Joseph L. Linsenmeyer, Tipp City, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 104 days.

(21) Appl. No.: 16/178,291

(22) Filed: Nov. 1, 2018

(65) Prior Publication Data

US 2019/0128554 A1 May 2, 2019

Related U.S. Application Data

(60) Provisional application No. 62/580,590, filed on Nov. 2, 2017.

(51) Int. Cl.
*F24F 11/86* (2018.01)
*F24F 11/42* (2018.01)
(Continued)

(52) U.S. Cl.
CPC ..... *F24F 11/86* (2018.01); *F24F 11/42* (2018.01); *F24F 11/61* (2018.01); *F24F 11/65* (2018.01);
(Continued)

(58) Field of Classification Search
CPC .. F24F 11/42; F24F 11/61; F24F 11/65; F24F 11/86; F24F 2110/12; F24F 2221/34;
(Continued)

(56) References Cited

U.S. PATENT DOCUMENTS 4,034,570 A * 7/1977 Anderson ..... F25B 49/02 62/158
2008/0028780 A1 2/2008 Song
(Continued)

FOREIGN PATENT DOCUMENTS

WO WO-2007-102889 A2 9/2007

OTHER PUBLICATIONS

International Search Report and Written Opinion issued in corresponding International Application No. PCT/US2018/058913, dated Feb. 26, 2019.

*Primary Examiner* — Kidest Bahta
(74) *Attorney, Agent, or Firm* — Harness, Dickey & Pierce, P.L.C.

(57) ABSTRACT

A climate-control system includes a variable-capacity compressor, an outdoor ambient temperature sensor, a user-controlled device, and a control module. The outdoor ambient temperature sensor indicates a temperature of outdoor ambient air. The user-controlled device provides a demand signal indicating a demand for at least one of heating and cooling. The control module commands a compressor stage and a stage run time based on the temperature from the outdoor ambient temperature sensor and the demand signal. The control module also modifies a lockout threshold based on a cycle run time, where the cycle run time is an actual run time for the compressor to meet a setpoint temperature.

25 Claims, 23 Drawing Sheets

(51) Int. Cl.

| | |
|---|---|
| ***F24F 11/65*** | (2018.01) |
| ***F24F 11/61*** | (2018.01) |
| ***F25B 49/02*** | (2006.01) |
| *F24F 110/12* | (2018.01) |
| *F25B 13/00* | (2006.01) |

(52) U.S. Cl.
CPC ..... *F25B 49/022* (2013.01); *F24F 2110/12* (2018.01); *F24F 2221/34* (2013.01); *F25B 13/00* (2013.01); *F25B 2600/0252* (2013.01); *F25B 2700/2104* (2013.01); *F25B 2700/2106* (2013.01)

(58) Field of Classification Search
CPC ..... F25B 13/00; F25B 2600/0252; F25B 2700/2104; F25B 2700/2106; F25B 49/022
See application file for complete search history.

(56) References Cited

U.S. PATENT DOCUMENTS

| | | | | |
|---|---|---|---|---|
| 2011/0264280 | A1 | 10/2011 | Grabinger et al. | |
| 2015/0089972 | A1* | 4/2015 | Kamiya ..... | F25B 13/00 62/467 |
| 2016/0313039 | A1* | 10/2016 | Popli ..... | F24F 11/86 |
| 2017/0176075 | A1 | 6/2017 | Karkhanis et al. | |

* cited by examiner

| OAT [°F] | | Heating Season | | | Cooling Season | | | Heating lockout adjustment column | Cooling lockout adjustment column |
|---|---|---|---|---|---|---|---|---|---|
| | Baseline RT | 3 strike outs | 3 strike outs | 3 strike outs | 3 strike outs | 3 strike outs | 3 strike outs | | |
| | Y1 RT | Y1 RT + adj. value | Y1 RT + adj. value | Y1 RT + adj. value | Y1 RT + adj. value | Y1 RT + adj. value | Y1 RT + adj. value | Adj. Value | Adj. Value |
| 100-105 | -30 | -30 | -30 | -30 | -20 | -10 | 0 | 0 | 10 |
| 95-100 | -20 | -20 | -20 | -20 | -10 | 0 | 10 | 0 | 10 |
| 90-95 | -10 | -10 | -10 | -10 | 0 | 10 | 20 | 0 | 10 |
| 85-90 | 0 | 0 | 0 | 0 | 10 | 20 | 30 | 0 | 10 |
| 80-85 | 20 | 20 | 20 | 20 | 30 | 40 | 50 | 0 | 10 |
| 75-80 | 25 | 25 | 25 | 25 | 35 | 45 | 55 | 0 | 10 |
| 70-75 | 30 | 30 | 30 | 30 | 40 | 50 | 60 | 0 | 10 |
| 65-70 | 40 | 40 | 40 | 40 | 50 | 60 | 70 | 0 | 10 |
| | | | | | | | | | |
| 60-65 | 40 | 50 | 60 | 70 | 70 | 70 | 70 | 10 | 0 |
| 55-60 | 40 | 50 | 60 | 70 | 70 | 70 | 70 | 10 | 0 |
| 50-55 | 30 | 40 | 50 | 60 | 60 | 60 | 60 | 10 | 0 |
| 45-50 | 25 | 35 | 45 | 55 | 55 | 55 | 55 | 10 | 0 |
| 40-45 | 20 | 30 | 40 | 50 | 50 | 50 | 50 | 10 | 0 |
| 35-40 | 0 | 10 | 20 | 30 | 30 | 30 | 30 | 10 | 0 |
| 30-35 | -10 | 0 | 10 | 20 | 20 | 20 | 20 | 10 | 0 |
| 25-30 | -20 | -10 | 0 | 10 | 10 | 10 | 10 | 10 | 0 |
| 20-25 | -30 | -20 | -10 | 0 | 0 | 0 | 0 | 10 | 0 |

Cooling Lockout
Heating Lockout

FIG. 12A

| OAT [°F] | | Heating Season | | | Cooling Season | | | Heating lockout adjustment column | Cooling lockout adjustment column |
|---|---|---|---|---|---|---|---|---|---|
| | Baseline RT | 2 reverse strikes ⬅ | 2 reverse strikes ⬅ | 2 reverse strikes | 2 reverse strikes | 2 reverse strikes | 2 reverse strikes | | |
| | Y1 RT | Y1 RT + adj. value | Y1 RT + adj. value | Y1 RT + adj. value | Y1 RT + adj. value | Y1 RT + adj. value | Y1 RT + adj. value | Adj. Value | Adj. Value |
| 100-105 | -30 | -30 | -30 | -30 | -20 | -10 | 0 | 0 | 10 |
| 95-100 | -20 | -20 | -20 | -20 | -10 | 0 | 10 | 0 | 10 |
| 90-95 | -10 | -10 | -10 | -10 | 0 | 10 | 20 | 0 | 10 |
| 85-90 | 0 | 0 | 0 | 0 | 10 | 20 | 30 | 0 | 10 |
| 80-85 | 20 | 20 | 20 | 20 | 30 | 40 | 50 | 0 | 10 |
| 75-80 | 25 | 25 | 25 | 25 | 35 | 45 | 55 | 0 | 10 |
| 70-75 | 30 | 30 | 30 | 30 | 40 | 50 | 60 | 0 | 10 |
| 65-70 | 40 | 40 | 40 | 40 | 50 | 60 | 70 | 0 | 10 |
| | | | | | | | | | |
| 60-65 | 40 | 50 | 60 | 70 | 70 | 70 | 70 | 10 | 0 |
| 55-60 | 40 | 50 | 60 | 70 | 70 | 70 | 70 | 10 | 0 |
| 50-55 | 30 | 40 | 50 | 60 | 60 | 60 | 60 | 10 | 0 |
| 45-50 | 25 | 35 | 45 | 55 | 55 | 55 | 55 | 10 | 0 |
| 40-45 | 20 | 30 | 40 | 50 | 50 | 50 | 50 | 10 | 0 |
| 35-40 | 0 | 10 | 20 | 30 | 30 | 30 | 30 | 10 | 0 |
| 30-35 | -10 | 0 | 10 | 20 | 20 | 20 | 20 | 10 | 0 |
| 25-30 | -20 | -10 | 0 | 10 | 10 | 10 | 10 | 10 | 0 |
| 20-25 | -30 | -20 | -10 | 0 | 0 | 0 | 0 | 10 | 0 |

Cooling Lockout
Heating Lockout

FIG. 12B

| OAT [°F] | Baseline RT | Heating Season | | | Cooling Season | | | Heating lockout adjustment column | Cooling lockout adjustment column |
|---|---|---|---|---|---|---|---|---|---|
| | | 3 strike outs → 2 reverse strikes ← | 3 strike outs → 2 reverse strikes ← | 3 strike outs | 3 strike outs | 3 strike outs | 3 strike outs | | |
| | Y1 RT | Y1 RT + adj. value | Y1 RT + adj. value | Y1 RT + adj. value | Y1 RT + adj. value | Y1 RT + adj. value | Y1 RT + adj. value | Adj. Value | Adj. Value |
| 100-105 | -30 | -30 | -30 | -30 | -30 | **-20** | -20 | 0 | 10 |
| 95-100 | -20 | -20 | -20 | -20 | -20 | **-10** | -10 | 0 | 10 |
| 90-95 | -10 | -10 | -10 | -10 | -10 | **0** | **10** | 0 | 10 |
| 85-90 | 0 | 0 | 0 | 0 | **10** | **20** | 20 | 0 | 10 |
| 80-85 | 20 | 20 | 20 | 20 | 20 | **30** | 30 | 0 | 10 |
| 75-80 | 25 | 25 | 25 | 25 | 25 | **35** | 35 | 0 | 10 |
| 70-75 | 30 | 30 | 30 | 30 | 30 | **40** | 40 | 0 | 10 |
| 65-70 | 40 | 40 | 40 | 40 | 40 | **50** | 50 | 0 | 10 |
| | | | | | | | | | |
| 60-65 | 40 | 40 | **50** | 50 | 50 | 50 | 50 | 10 | 0 |
| 55-60 | 40 | 40 | **50** | 50 | 50 | 50 | 50 | 10 | 0 |
| 50-55 | 30 | 30 | **40** | 40 | 40 | 40 | 40 | 10 | 0 |
| 45-50 | 25 | 25 | **35** | 35 | 35 | 35 | 35 | 10 | 0 |
| 40-45 | 20 | 20 | **30** | 30 | 30 | 30 | 30 | 10 | 0 |
| 35-40 | 0 | **10** | **20** | 20 | 20 | 20 | 20 | 10 | 0 |
| 30-35 | -10 | -10 | **0** | **10** | 10 | 10 | 10 | 10 | 0 |
| 25-30 | -20 | -20 | **-10** | -10 | -10 | -10 | -10 | 10 | 0 |
| 20-25 | -30 | -30 | **-20** | -20 | -20 | -20 | -20 | 10 | 0 |

Cooling Lockout
Heating Lockout

FIG. 14

| OAT [°F] | | Cooling Season | | | Heating lockout adjustment column | Cooling lockout adjustment column |
|---|---|---|---|---|---|---|
| | Baseline RT | 3 strike outs 2 reverse strikes | 3 strike outs 2 reverse strikes | 3 strike outs | | |
| | Y2 RT | Y2 RT – lockout column RT | Y2 RT – adj. value | Y2 RT – lockout column RT | Adj. Value | Adj. Value |
| 100-105 | 70 | 70 | 60 | 50 | 0 | 10 |
| 95-100 | 60 | 60 | 50 | 40 | 0 | 10 |
| 90-95 | 50 | 50 | 40 | 30 | 0 | 10 |
| 85-90 | 40 | 40 | 30 | 20 | 0 | 10 |
| 80-85 | 30 | 30 | 20 | 10 | 0 | 10 |
| 75-80 | 20 | 20 | 10 | 0 | 0 | 10 |
| 70-75 | 10 | 10 | 0 | -10 | 0 | 10 |
| 65-70 | 0 | 0 | -10 | -20 | 0 | 10 |

FIG. 18

SYSTEM AND METHOD OF ADJUSTING COMPRESSOR MODULATION RANGE BASED ON BALANCE POINT DETECTION OF THE CONDITIONED SPACE

CROSS-REFERENCE TO RELATED APPLICATIONS

This application claims the benefit of U.S. Provisional Application No. 62/580,590, filed on Nov. 2, 2017. The entire disclosure of the above application is incorporated herein by reference.

FIELD

The present disclosure relates to a climate-control system having a compressor and to methods for adjusting compressor modulation range based on balance point detection of the space conditioned by the climate-control system.

BACKGROUND

This section provides background information related to the present disclosure which is not necessarily prior art.

A climate-control system such as, for example, a heat-pump system, a refrigeration system, or an air conditioning system, may include a fluid circuit having an outdoor heat exchanger, an indoor heat exchanger, an expansion device disposed between the indoor and outdoor heat exchangers, and a compressor circulating a working fluid (e.g., refrigerant or carbon dioxide) between the indoor and outdoor heat exchangers. Varying a capacity of the compressor can impact the energy-efficiency of the system and the speed with which the system is able to heat or cool a room or space.

SUMMARY

This section provides a general summary of the disclosure, and is not a comprehensive disclosure of its full scope or all of its features.

An example embodiment of a climate-control system of the present disclosure includes a variable-capacity compressor, an outdoor ambient temperature sensor, a user-controlled device, and a control module. The outdoor ambient temperature sensor indicates a temperature of outdoor ambient air. The user-controlled device provides a compressor demand signal indicating a compressor demand. The control module commands a compressor stage and a stage run time based on the temperature from the outdoor ambient temperature sensor. The control module also modifies a lockout threshold based on a cycle run time, where the cycle run time is an actual run time for the compressor to meet a setpoint temperature.

The climate-control system may further include a control module that increases a strike counter when the cycle run time for the last three cycles is less than fifteen minutes per cycle and a difference between the outdoor ambient temperature and a heating lockout temperature is within a predetermined range.

The climate-control system may further include a control module that modifies the lockout threshold when the strike counter reaches three strikes.

The climate-control system may further include a lockout threshold that is a heating lockout threshold, and the control module modifies the heating lockout threshold by adding a heating lockout adjustment column to a run time column in a run time table.

The climate-control system may further include a lockout threshold that is a heating lockout threshold, and the control module modifies the heating lockout threshold by adding ten minutes to a run time at the heating lockout threshold.

The climate-control system may further include a control module that increases a strike counter when the cycle run time for the last three cycles is at least fifteen minutes per cycle and a difference between the outdoor ambient temperature and a cooling lockout temperature is within a predetermined range.

The climate-control system may further include a control module that modifies the lockout threshold when the strike counter reaches three strikes.

The climate-control system may further include a lockout threshold that is a cooling lockout threshold, and the control module modifies the cooling lockout threshold by adding a cooling lockout adjustment column to a run time column in a run time table.

The climate-control system may further include a lockout threshold that is a cooling lockout threshold, and the control module modifies the cooling lockout threshold by adding ten minutes to a run time at the cooling lockout threshold.

The climate-control system may further include a control module that increases a reverse strike counter when the cycle run time for the last two cycles is at least forty minutes per cycle and a difference between the outdoor ambient temperature and a heating lockout temperature is within a predetermined range.

The climate-control system may further include a control module that modifies the lockout threshold when the reverse strike counter reaches two strikes.

The climate-control system may further include a lockout threshold that is a heating lockout threshold, and the control module modifies the heating lockout threshold by subtracting a heating lockout adjustment column from a run time column in a run time table.

The climate-control system may further include a lockout threshold that is a heating lockout threshold, and the control module modifies the heating lockout threshold by subtracting ten minutes from a run time at the heating lockout threshold.

The climate-control system may further include a control module that increases a reverse strike counter when the cycle run time for the last two cycles is at least forty minutes per cycle and a difference between the outdoor ambient temperature and a cooling lockout temperature is within a predetermined range.

The climate-control system may further include a control module that modifies the lockout threshold when the reverse strike counter reaches two strikes.

The climate-control system may further include a lockout threshold that is a cooling lockout threshold, and the control module modifies the cooling lockout threshold by subtracting a cooling lockout adjustment column from a run time column in a run time table.

The climate-control system may further include a lockout threshold that is a cooling lockout threshold, and the control module modifies the cooling lockout threshold by subtracting ten minutes from a run time at the cooling lockout threshold.

The climate-control system may further include a user-controlled device that is a thermostat.

The climate-control system may further include a user-controlled device that is an application on a mobile device.

The climate-control system may further include an auxiliary heater.

The climate-control system may further include a control module that selectively enables the auxiliary heater based on at least one of the compressor stage, the outdoor ambient temperature, the lockout threshold, and the cycle run time.

The climate-control system may further include a control module that enables the auxiliary heater if the compressor is running in high stage and a defrost signal is enabled.

The climate-control system may further include a control module that enables the auxiliary heater if the cycle run time is greater than sixty minutes.

The climate-control system may further include a control module that enables the auxiliary heater if the outdoor ambient temperature is less than the lockout threshold and the cycle run time is greater than twenty minutes.

An example method for controlling a climate-control system having a variable-capacity compressor according to the present disclosure includes indicating, by an outdoor ambient temperature sensor, a temperature of outdoor ambient air; receiving, from a user-controlled device, a compressor demand signal indicating a compressor demand; commanding, by a control module, a compressor stage and a stage run time based on the temperature from the outdoor ambient temperature sensor; and modifying, by the control module, a lockout threshold based on a cycle run time, where the cycle run time is an actual run time for the compressor to meet a setpoint temperature.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIG. 12A is an example compressor run time table according to the present disclosure.

FIG. 12B is another example compressor run time table according to the present disclosure.

FIG. 14 is another example compressor run time table according to the present disclosure.

FIG. 18 is another example compressor run time table according to the present disclosure.

Corresponding reference numerals indicate corresponding parts throughout the several views of the drawings.

DETAILED DESCRIPTION

Figure 1:
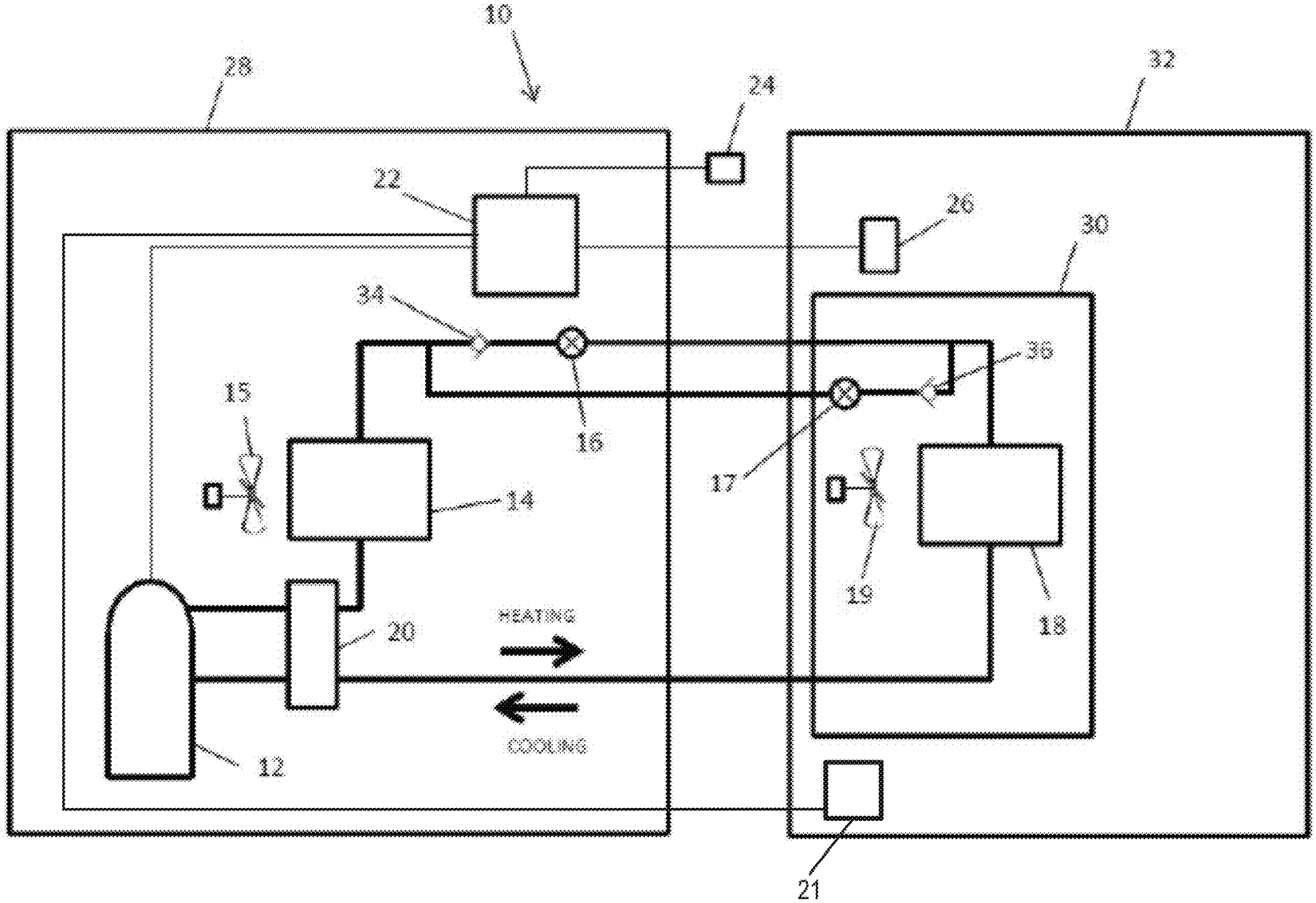
FIG. 1 is a schematic representation of a climate-control system having a variable-capacity compressor according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIG. 1, a climate-control system 10 is provided that may include a variable-capacity compressor (or a variable-capacity group of compressors) 12, an outdoor heat exchanger 14, an outdoor blower 15, a first expansion device 16, a second expansion device 17, an indoor heat exchanger 18, and an indoor blower 19. In the particular configuration shown in FIG. 1, the system 10 is a heat-pump system having a reversing valve 20 operable to control a direction of working fluid flow through the system 10 to switch the system 10 between a heating mode and a cooling mode. In some configurations, the system 10 may be an air-conditioning system or a refrigeration system, for example, and may be operable in only the cooling mode.

Some embodiments further include an auxiliary heater 21. The auxiliary heater 21 is an electric, gas, or oil backup heater that may be included on a compressor system having an ambient temperature below which it is locked into high stage. The auxiliary heater 21 is used to supplement the climate-control system when the system is unable to meet a setpoint in a heating mode after a predetermined runtime.

As will be described in more detail below, a controller or control module 22 may control operation of the compressor 12 and may switch the compressor 12 between a low-capacity mode and a high-capacity mode based on data received from an outdoor-air-temperature sensor 24, a signal received from a thermostat 26, a heating lockout, a cooling lockout, a runtime (RT), a previous runtime (RT), and/or a comparison between the runtime or previous runtime and a predetermined value. The control module 22 may adjust heating and cooling lockout points to increase efficiency, minimize or reduce energy usage, avoid short cycling, and minimize or reduce auxiliary heat usage while maintaining an acceptable level of comfort within a space to be heated or cooled.

The compressor 12 can be or include a scroll compressor, a reciprocating compressor, or a rotary vane compressor, for example, and/or any other type of compressor. The compressor 12 may be any type of variable-capacity compressor that is operable in at least a low-capacity mode and a high-capacity mode. For example, the compressor 12 may be or include a multi-stage compressor, a group of independently operable compressors, a multi-speed or variable-speed compressor (having a variable-speed or multi-speed motor), a compressor having modulated suction (e.g., blocked suction), a compressor having fluid-injection (e.g., an economizer circuit), a pulse-width-modulated scroll compressor configured for scroll separation (e.g., a digital scroll compressor), a compressor having variable-volume-ratio valves configured to leak intermediate-pressure working fluid, or a compressor having two or more of the above capacity modulation means. It will be appreciated that the compressor 12 could include any other additional or alternative structure for varying its capacity and/or the operating capacity of the system 10.

It will be appreciated that the low-capacity and/or high-capacity modes may be continuous, steady-state operating modes, or compressor 12 may be modulated (e.g., pulse-width-modulated) during operation in the low-capacity mode and/or during operation in the high-capacity mode. Exemplary variable-capacity compressors are disclosed in assignee's commonly owned U.S. Pat. Nos. 8,616,014, 6,679,072, 8,585,382, 6,213,731, 8,485,789, 8,459,053, and 5,385,453, the disclosures of which are hereby incorporated by reference.

The compressor 12, the outdoor heat exchanger 14, the outdoor blower 15, the first expansion device 16, and the reversing valve 20 may be disposed in an outdoor unit 28. The second expansion device 17, the indoor heat exchanger 18 and the indoor blower 19 may be disposed within an indoor unit 30 (e.g., an air handler or furnace) disposed within a home or other building 32. The auxiliary heater 21 may be a separate unit or may be disposed within the indoor unit 30. A first check valve 34 may be disposed between outdoor heat exchanger 14 and the first expansion device 16 and may restrict or prevent fluid flow through the first expansion device 16 in the cooling mode and may allow fluid flow through the first expansion device 16 in the heating mode. A second check valve 36 may be disposed between the second expansion device 17 and the indoor heat exchanger 18 and may restrict or prevent fluid flow through the second expansion device 17 in the heating mode and may allow fluid flow through the second expansion device 17 in the cooling mode.

The thermostat 26 may be disposed inside of the building 32 and is configured to provide an indoor set point that is adjustable by a user. The thermostat 26 further provides a compressor demand signal to the control module 22. In alternative embodiments, the thermostat 26 may be a user-controlled device, an external application, or program, such as an application on a mobile device, or a program schedule set by a user.

The outdoor-air-temperature sensor 24 is disposed outside of the building 32 and within or outside of the outdoor unit 28 and is configured to measure an outdoor ambient air temperature and communicate the outdoor ambient air temperature value to the control module 22 intermittently, continuously or on-demand. In some configurations, the outside-air-temperature sensor 24 could be a thermometer or other sensor associated with a weather monitoring and/or weather reporting system or entity. In such configurations, the control module 22 may obtain the outdoor-air temperature (measured by the sensor 24) from the weather monitoring and/or weather reporting system or entity via, for example, an internet, Wi-Fi, Bluetooth®, Zigbee®, power-line carrier communication (PLCC), or cellular connection or any other wired or wireless communication protocol.

For example, the control module 22 may communicate with the weather monitoring and/or weather reporting system or entity over the internet via a Wi-Fi connection to a Wi-Fi router located in or associated with the building 32. The thermostat 26 is disposed inside of the building 32 and outside of the indoor unit 30 and is configured to measure an air temperature within a room or space to be cooled or heated by the system 10. The thermostat 26 can be a single-stage thermostat, for example, that generates only one type of demand signal in response to a temperature within the room or space rising above (in the cooling mode) or falling below (in the heating mode) a setpoint temperature.

In some embodiments, a return air temperature sensor (not pictured) may be used in lieu of, or in conjunction with, the thermostat. The return air temperature sensor provides a temperature of the return air for the cooled or heated space. In other embodiments, a space temperature sensor (not pictured) may be used in lieu of, or in conjunction with, the thermostat and/or the return air temperature sensor. The space temperature sensor provides a temperature of one or more locations in the cooled or heated space.

The control module 22 could be disposed in any suitable location, such as inside of or adjacent to the outdoor unit 28 or inside of or adjacent to the indoor unit 30, for example.

In the cooling mode, the outdoor heat exchanger 14 may operate as a condenser or as a gas cooler and may cool discharge-pressure working fluid received from the compressor 12 by transferring heat from the working fluid to air forced over the outdoor heat exchanger 14 by the outdoor blower 15, for example. The outdoor blower 15 could include a fixed-speed, multi-speed or variable-speed fan. In the cooling mode, the indoor heat exchanger 18 may operate as an evaporator in which the working fluid absorbs heat from air forced over the indoor heat exchanger 18 by the indoor blower 19 to cool a space within the home or building 32. The indoor blower 19 could include a fixed-speed, multi-speed or variable-speed fan. In the heating mode, the outdoor heat exchanger 14 may operate as an evaporator, and the indoor heat exchanger 18 may operate as a condenser or as a gas cooler and may transfer heat from working fluid discharged from the compressor 12 to a space to be heated.

Figure 2:
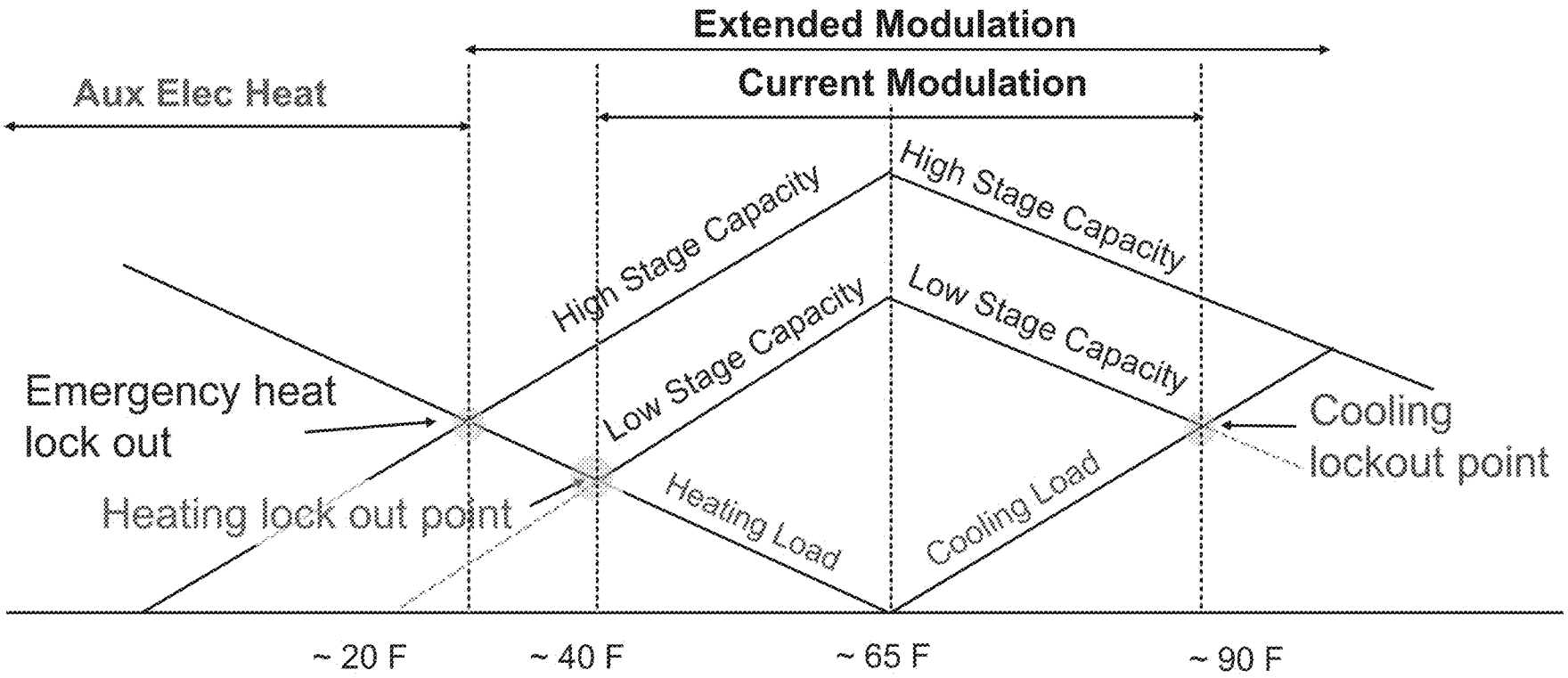
FIG. 2 is a graph of example control strategies incorporating heating and cooling lockout points.

Now referring to FIG. 2, example control strategies incorporating heating and cooling lockout points are illustrated. A lockout point refers to an ambient temperature above or below which the control module commands the compressor to run only in or primarily in high stage for maximum cooling or heating capacity. In most cases, this ambient temperature is very conservative. The heating lockout point is the ambient temperature below which the compressor always runs in the high or highest capacity stage (i.e., no low stage operation is permitted). The cooling lockout point is the ambient temperature above which the compressor always runs in the high or highest capacity stage (i.e., no low stage operation is permitted). Typically, the lockout points at both extremes (i.e. heating and cooling) are generic values since load on the structure is unknown and the lockout temperature must be set to work in houses and/or commercial buildings in different regions (either the entire country or the entire market region), environmental conditions, and/or user preferences.

Typically, a fixed compressor system may have an ambient temperature below which it is locked into high stage. These units typically have electric, gas, or oil backup heating, or auxiliary heating. If an auxiliary heater is present in the system, the control module will command the auxiliary heater ON if the ambient temperature is below the heating lockout point. In current climate-control configurations, the heating lockout point is typically set to 40° F. An example modulation zone for current climate-control systems with a fixed compressor system is illustrated in FIG. 2 and labeled as "Current Modulation."

However, the control module could extend the modulation zone or operation time to reduce auxiliary heat usage, increase energy savings, avoid short cycling, and/or enhance comfort. The control module could account for regional differences, a type of user (i.e., energy or comfort conscious, high or low thermostat settings, setback or no setback, age, etc.), or a type of construction of the structure or conditioned space (type of building, insulation, solar load, shading, etc.). Utilizing knowledge of the ambient temperature and run time, the control module can look for predetermined parameter values and adapt the lockout points to be customized for the individual system. Additionally, enhancements that allow the control module to account for indoor parameters (for example, indoor temperature and relative humidity), indoor blower control, and/or auxiliary heat control can provide greater benefits to the extended modulation. For example, an extended modulation zone for climate-control systems is illustrated in FIG. 2 and labeled as "Extended Modulation."

A flexible lockout point (which enables extended modulation) provides benefits in very low ambient conditions, very high ambient conditions, and mid-range ambient conditions. In mid-range ambient conditions, the flexible lockout point enhances comfort and avoids short cycling in high stage.

In low ambient conditions, the flexible lockout point adjusts for over/under compressor-sizing mismatch especially in a partial replacement situation. The flexible lockout point further reduces the auxiliary heat usage (by setting the threshold for turning on to a lower temperature) and increases energy savings (by locking the compressor in high stage at a lower temperature).

In high ambient conditions, the flexible lockout point adjusts for over/under compressor-sizing mismatch especially in a partial replacement situation. The flexible lockout point further avoids short cycling by increasing the temperature at which the compressor is locked into a high stage.

Figure 3:
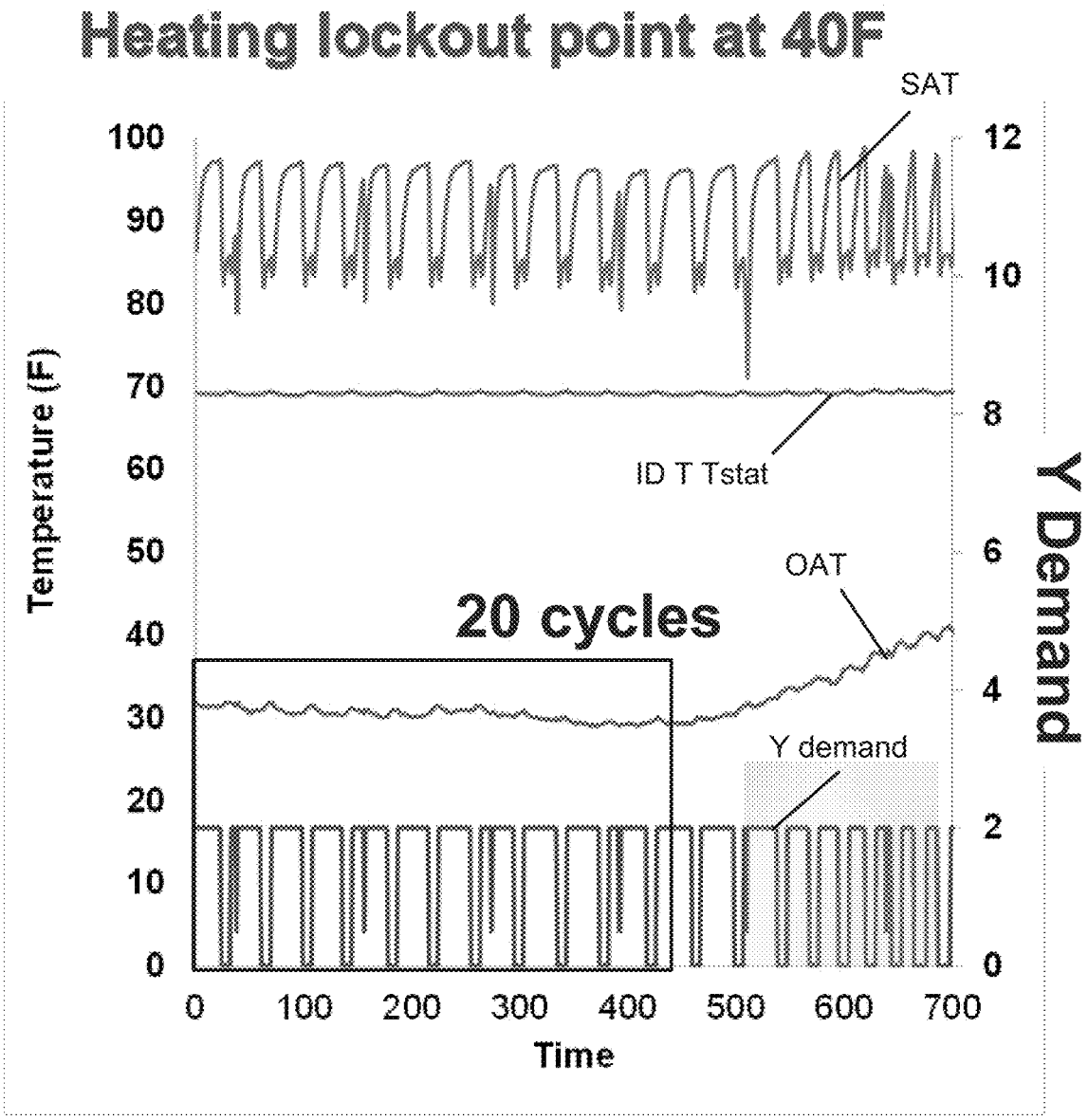
FIG. 3 (prior art)
FIG. 3 is a graph of supply air temperature, indoor thermostat temperature, outdoor air temperature, and demand when a heating lockout point is set to 40° F.

As previously stated, in current climate-control configurations having fixed compressors, the heating lockout point is typically set to 40° F. As such, the compressor is locked in high stage once the ambient temperature reaches 40° F. or lower. As shown in FIG. 3, with the lockout point set to 40° F. and the compressor only having an ON stage and an OFF stage (i.e., fixed compressor), the cycling time decreases as temperature increases, leading to short cycling. The short cycling is evident in FIG. 3 which displays 20 cycles over the graphed time period.

Figure 4:
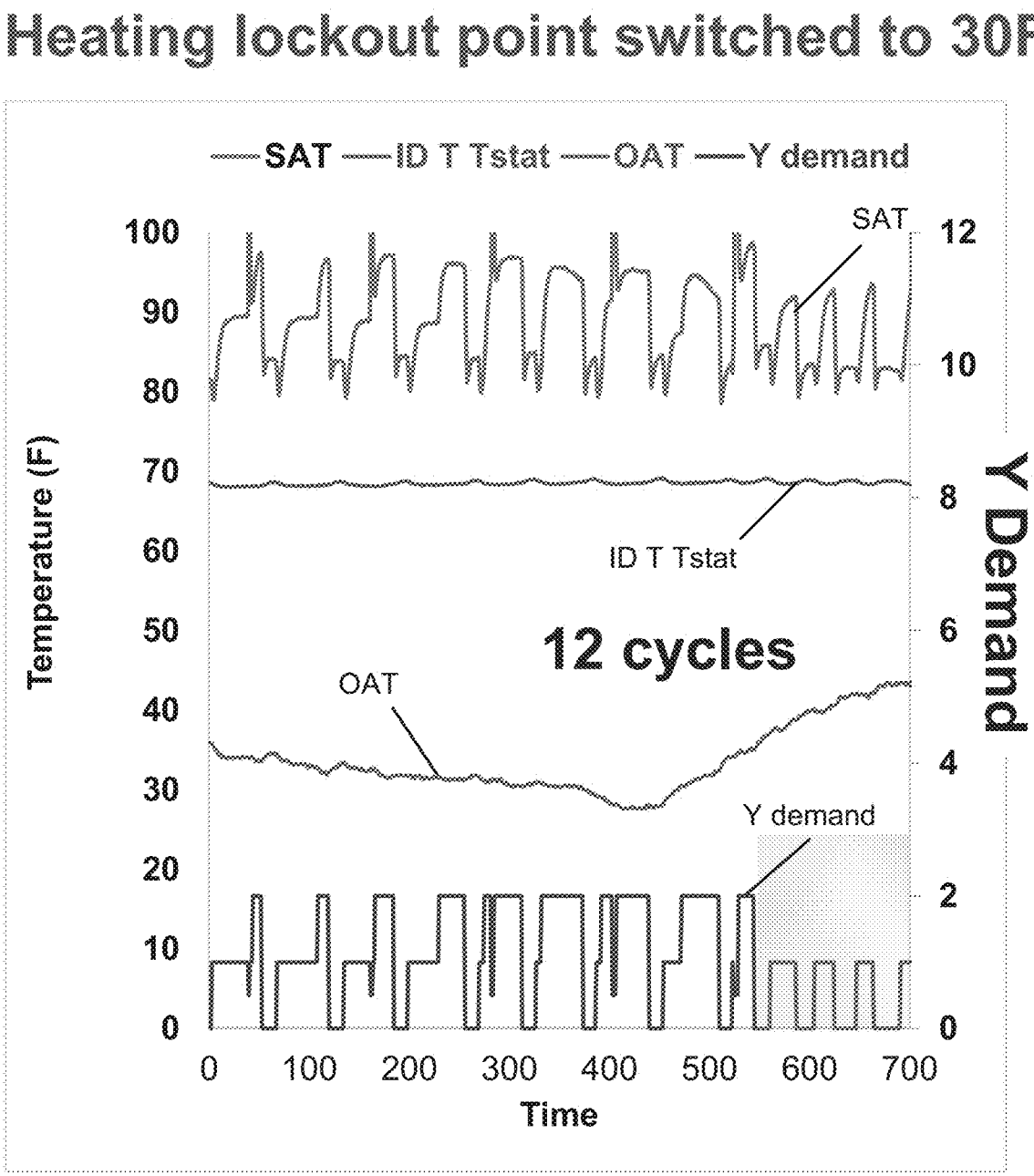
FIG. 4 is a graph of supply air temperature, indoor thermostat temperature, outdoor air temperature, and demand when a heating lockout point is set to 30° F.

By extending the modulation zone or operation time primarily with the knowledge of ambient temperature (OAT) and run time (RT), and enhanced with indoor parameters (for example, indoor temperature and relative humidity), indoor blower control, and auxiliary heat control, the energy savings may be increased, short cycling may be avoided, and comfort may be enhanced. As shown in FIG. 4, with the lockout point set to 30° F. and the compressor having multiple capacities (i.e. a two stage compressor), the cycling time increases as compared to FIG. 3. The compressor spends more time in a low stage leading to fewer cooling or heating run cycles which reduces wear and tear on the compressor because the compressor runs longer and delivers the correct amount of cooling or heating that the conditioned space needs. Thus, the system does not "short-cycle," i.e., the system does not run shorter cooling or heating cycles with more cooling or heating capacity than the conditioned space requires. When the compressor runs fewer cycles in a given amount of time or over a day/season, it starts up and shuts down fewer times, which enhances the compressor and system lifetime. As shown in FIG. 4, the number of cycles is reduced by 40% when the heating lockout point is decreased 10° to 30° F. Due to a controlled cooling or heating capacity being delivered to the conditioned space at a steady, modulated rate, the occupants experience fewer fluctuations in space temperature and relative humidity conditions, which leads to more comfortable conditions for the occupants.

Figure 5:
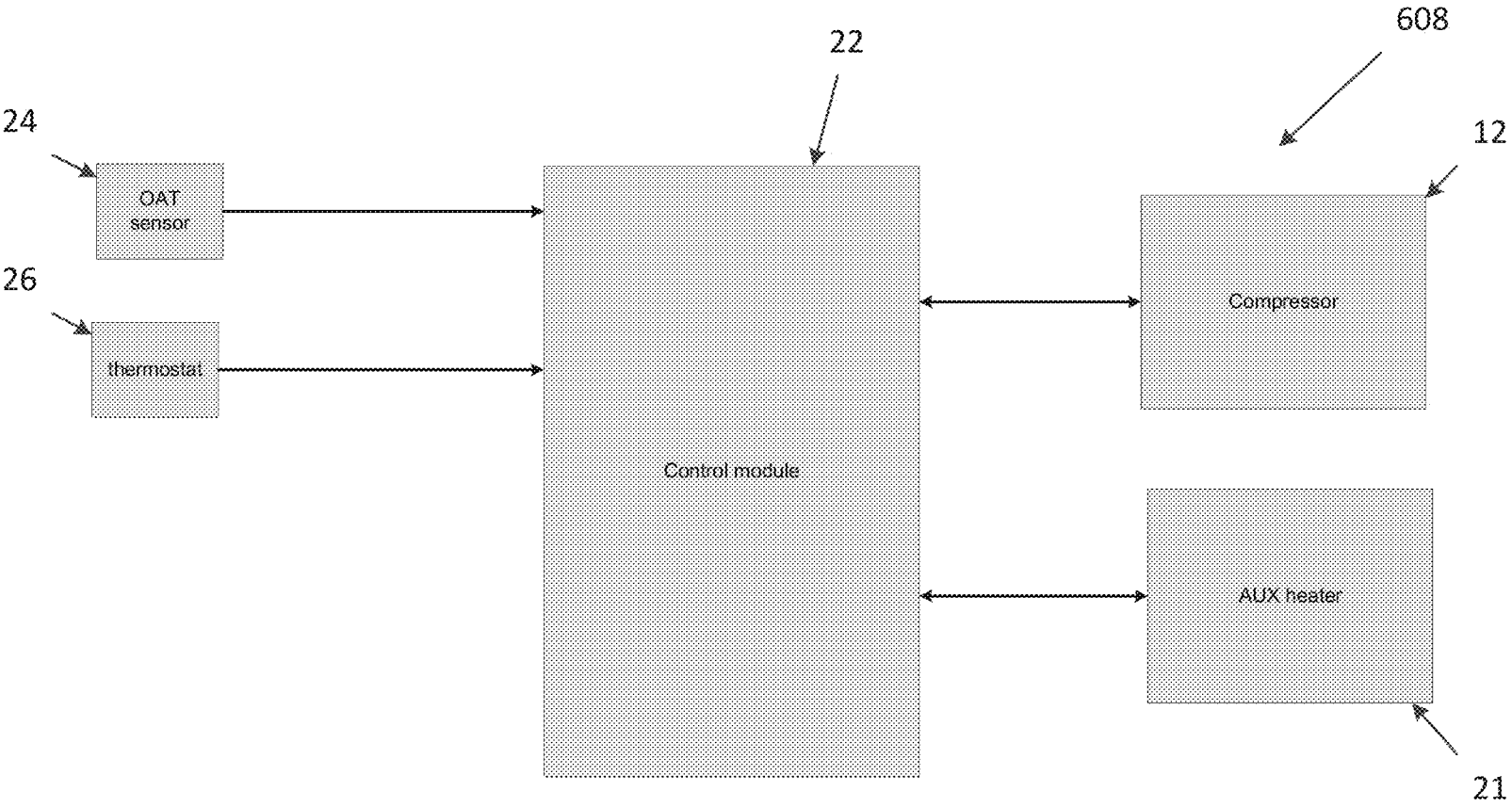
FIG. 5 is a block diagram of a climate-control system according to the present disclosure.

Now referring to FIG. 5, a block diagram of a portion of the climate-control system is illustrated. The control module 22 receives signals from the outdoor ambient temperature sensor 24 and the thermostat 26 indicating an outdoor ambient temperature and a compressor demand, respectively. The control module 22 further communicates with both the compressor 12 and the auxiliary heater 21 to receive operating parameters (for example only, run time), and provide operating commands.

The control module 22 may utilize the parameters received from the outdoor ambient temperature sensor 24, the thermostat 26, the compressor 12, and the auxiliary heater 21 to carry out the methods described below (i.e., in relation to FIGS. 6, 8, 9, 11, 13, 15, 16, 20, 22) and control operation of the compressor 12 and auxiliary heater 21. For example, the control module 22 may command the compressor 12 to operate at a high capacity or low capacity based on the outdoor ambient temperature. If the outdoor ambient temperature is less than a threshold (for example only, 65° F.), the control module 22 may control the climate-control system to operate in a heating mode, and if the outdoor ambient temperature is greater than the threshold, the control module 22 may control the climate-control system to operate in a cooling mode.

In the heating mode, the control module 22 may compare the outdoor ambient temperature to the heating lockout temperature and, if the difference is within a range (for example only −10 to 0° F.), may begin an observation period. If outside the range, the control module 22 may continue regular operation. During the observation period, the control module 22 may monitor the high stage run time for the compressor 12 and may modify the heating lockout temperature based on the cycle run time.

In the cooling mode, the control module 22 may compare the outdoor ambient temperature to the cooling lockout temperature and, if within a range (for example only 0 to 10° F.), may begin an observation period. If outside the range, the control module 22 may continue regular operation. During the observation period, the control module 22 may monitor the high stage run time for the compressor 12 and may modify the cooling lockout temperature based on the cycle time.

Figure 6:
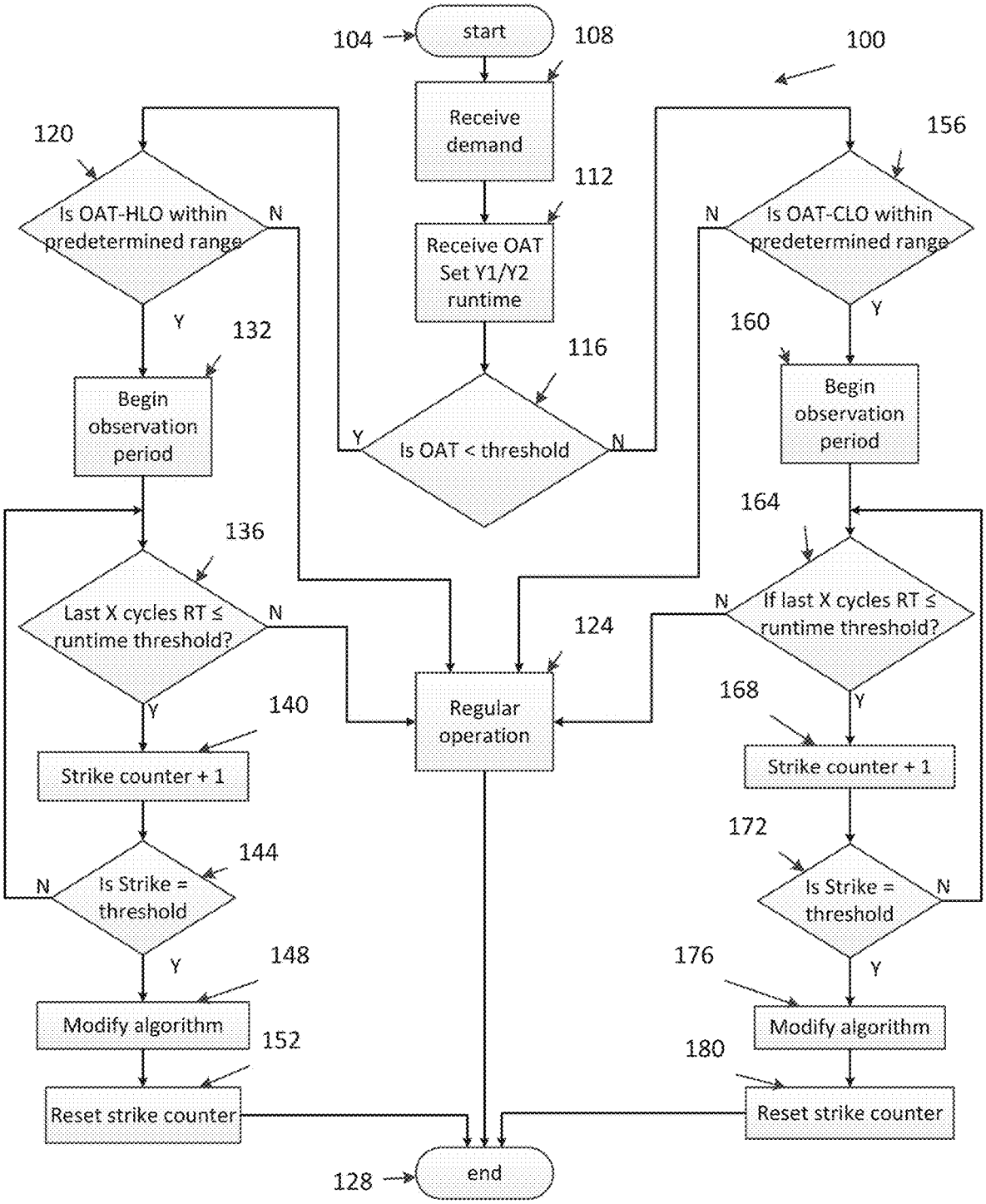
FIG. 6 is flowchart of a method for controlling a climate-control system according to the present disclosure.

Now referring to FIG. 6, a method 100 for controlling the climate-control system 10 is illustrated. Method 100 may be performed by control module 22 in conjunction with the outdoor ambient temperature sensor 24, the thermostat 26, and the compressor 12. Method 100 starts at 104. At 108, the control module 22 receives a compressor capacity demand. The compressor demand may be sent as a signal from the thermostat 26.

At 112, the control module 22 receives an outdoor ambient temperature and commands the compressor 12 to a low stage or a high stage based on the outdoor ambient temperature. The outdoor ambient temperature may be provided by a signal from the outdoor ambient temperature sensor 24. For example, referring to FIG. 12A an example compressor runtime table is provided. At startup, the control module 22 will command runtimes from the baseline column of the runtime table. Thus, if the outdoor ambient temperature is 75° F., the control module 22 will command the compressor 12 to run at a low capacity stage for 25 minutes. If the demand is still present after 25 minutes, the control module 22 will command the compressor 12 to run at a high capacity stage.

At 116, control module 22 determines whether the outdoor ambient temperature is less than a temperature threshold. The temperature threshold may be set to a temperature where a majority of users do not utilize heating or cooling or a temperature where a majority of users switch from a cooling mode to a heating mode or vice versa. For example only, the temperature threshold may be 65° F. If the outdoor ambient temperature is less than the temperature threshold, the control module 22 determines a difference between the outdoor ambient temperature and a heating lockout temperature and determines whether the difference is within a predetermined range at 120. The control module 22 may subtract the heating lockout temperature from the outdoor ambient temperature to determine the difference. For example only, the predetermined range may be between −10 and 0° F.

If the difference is not within the predetermined range, the control module 22 proceeds with regular operation at 124. For example, regular operation may be commanding runtimes from the baseline column of the runtime table. Thus, if the outdoor ambient temperature is 55° F., the control module 22 will command the compressor 12 to run at a low capacity stage for 30 minutes. If the demand is still present after 30 minutes, the control module 22 will command the compressor 12 to run at a high capacity stage. The method 100 then ends at 128.

If the difference is within the predetermined range at 120, the control module 22 begins an observation period at 132. During the observation period, the control module 22 monitors the cycle runtimes. At 136, the control module 22 determines whether the runtimes for predetermined number of compressor cycles is less than or equal to a runtime threshold. For example only, the runtime threshold may be 15 minutes/cycle and the predetermined number of compressor cycles may be three. The three compressor cycles may be consecutive cycles or may be three compressor cycles out of a predetermined number, such as five.

If the runtimes for the predetermined number of compressor cycles is not less than or equal to a runtime threshold, the control module 22 proceeds with regular operation at 124. For example, regular operation may be commanding runtimes from the baseline column of the runtime table. Thus, if the outdoor ambient temperature is 45° F., the control module 22 will command the compressor 12 to run at a low capacity stage for 25 minutes. If the demand is still present after 25 minutes, the control module 22 will command the compressor 12 to run at a high capacity stage. The method 100 then ends at 128.

If the runtimes for the predetermined number of compressor cycles is less than or equal to a runtime threshold at 136, the control module 22 adds a strike to a strike counter at 140. If the number of strikes in the strike counter is less than a threshold (for example only, three) at 144, the method 100 returns to 136. If the number of strikes in the strike counter is equal to the threshold (for example only, three) at 144, the control module 22 modifies the control algorithm at 148.

For example, the control module 22 may make a heating lockout adjustment at 148. For example, with respect to the table in FIG. 12A, a value in the heating lockout column is added to a value in a Y1 (demand for compressor 1) run time column to change the temperature of the heating lockout. If the compressor 12 is running in the baseline runtime column, the compressor 12 will operate at the requested demand (Y1 demand) for a run time (in the baseline RT column) corresponding to the outside ambient temperature (for example, 20 minutes at an OAT of 40-45° F.). If three strikes are accumulated, the value from the heating lockout adjustment column is added to the baseline run time (RT) column to equate the adjacent Y1 RT+adj. value column. Then the compressor 12 operates at the requested demand (Y1 demand) for a run time corresponding to the outside ambient temperature (for example, 30 minutes at an OAT of 40-45° F.). Each time the control module 22 adjusts the heating lockout at 148, the compressor 12 will operate for a run time in an adjacent Y1 RT+adj. value column to the right of the previous column in the "heating season" section.

At 152, the control module 22 resets the strike counter to zero. At 128, the method 100 ends.

Returning to 116, if the outdoor ambient temperature is not less than the temperature threshold, the control module 22 determines a difference between the outdoor ambient temperature and a cooling lockout temperature and determines whether the difference is within a predetermined range at 156. The control module 22 may subtract the cooling lockout temperature from the outdoor ambient temperature to determine the difference. For example only, the predetermined range may be between 0 and 10° F.

If the difference is not within the predetermined range, the control module 22 proceeds with regular operation at 124. For example, regular operation may be commanding runtimes from the baseline column of the runtime table. Thus, if the outdoor ambient temperature is 75° F., the control module 22 will command the compressor 12 to run at a low capacity stage for 25 minutes. If the demand is still present after 25 minutes, the control module 22 will command the compressor 12 to run at a high capacity stage. The method 100 then ends at 128.

If the difference is within the predetermined range at 156, the control module 22 begins an observation period at 160. During the observation period, the control module 22 monitors the cycle runtimes. At 164, the control module 22 determines whether the runtimes for a predetermined number of compressor cycles is less than or equal to a runtime threshold. For example only, the runtime threshold may be 15 minutes/cycle and the predetermined number of compressor cycles may be three. The three compressor cycles may be consecutive cycles or may be three compressor cycles out of a predetermined number, such as five.

If the runtimes for the predetermined number of compressor cycles is not less than or equal to a runtime threshold, the control module 22 proceeds with regular operation at 124. For example, regular operation may be commanding runtimes from the baseline column of the runtime table. Thus, if the outdoor ambient temperature is 85° F., the control module 22 will command the compressor 12 to run at a low capacity stage for 20 minutes. If the demand is still present after 20 minutes, the control module 22 will command the compressor 12 to run at a high capacity stage. The method 100 then ends at 128.

If the runtimes for the predetermined number of compressor cycles is less than or equal to a runtime threshold at 164, the control module 22 adds a strike to a strike counter at 168. If the number of strikes in the strike counter is less than a threshold (for example only, three) at 172, the method 100 returns to 164. If the number of strikes in the strike counter is equal to the threshold (for example only, three) at 172, the control module 22 modifies the control algorithm at 176.

For example, the control module 22 may make a cooling lockout adjustment at 176. For example, with respect to the table in FIG. 12A, a cooling lockout column is added to the Y1 RT column to change the temperature of the cooling lockout. If the compressor 12 is running in the Baseline RT (run time) column, the compressor 12 will operate at the requested demand (Y1 demand) for a run time (in the baseline RT column) corresponding to the outside ambient temperature (for example, 20 minutes at an OAT of 80-85° F.). If three strikes are accumulated, the value from the cooling lockout adjustment column is added to the Baseline RT column to equate the first Y1 RT+adj. value column in the Cooling Season section. Then the compressor 12 operates at the requested demand (Y1 demand) for a run time corresponding to the outside ambient temperature (for example, 30 minutes at an OAT of 80-85° F.). Each time the control module 22 adjusts the cooling lockout at 176, the compressor 12 will operate for a run time in an adjacent Y1 RT+adj. value column to the right of the previous column in the "Cooling Season" section.

At 180, the control module 22 resets the strike counter to zero. At 128, the method 100 ends.

Figure 7:
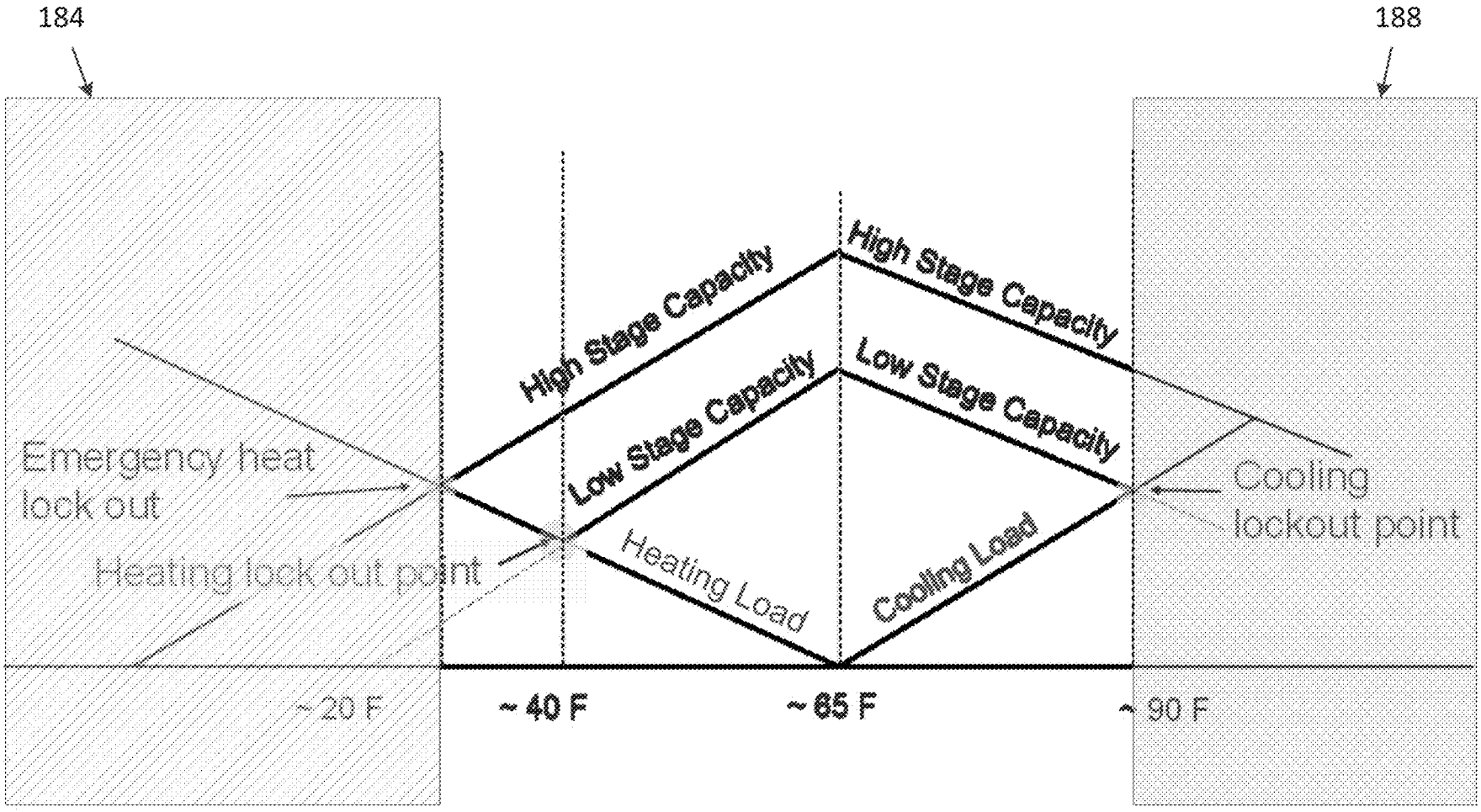
FIG. 7 is a graph of the example control strategy of FIG. 6 incorporating heating and cooling lockout points.

Now referring to FIG. 7, the method 100 of FIG. 6 monitors the shaded areas displayed in the graph. The heating cycle (references 120-152 of FIG. 6) portion of the method 100 focuses on the shaded block 184, and the cooling cycle (references 156-180) portion of the method 100 focuses on the shaded block 188. The shaded block 184 includes the temperatures below the emergency heat lockout point (for example only, 30° F.). The shaded block 188 includes the temperatures higher than the cooling lockout point (for example only, 90° F.). Thus, the method 100 focuses on the outer extremes in temperatures.

Figure 8:
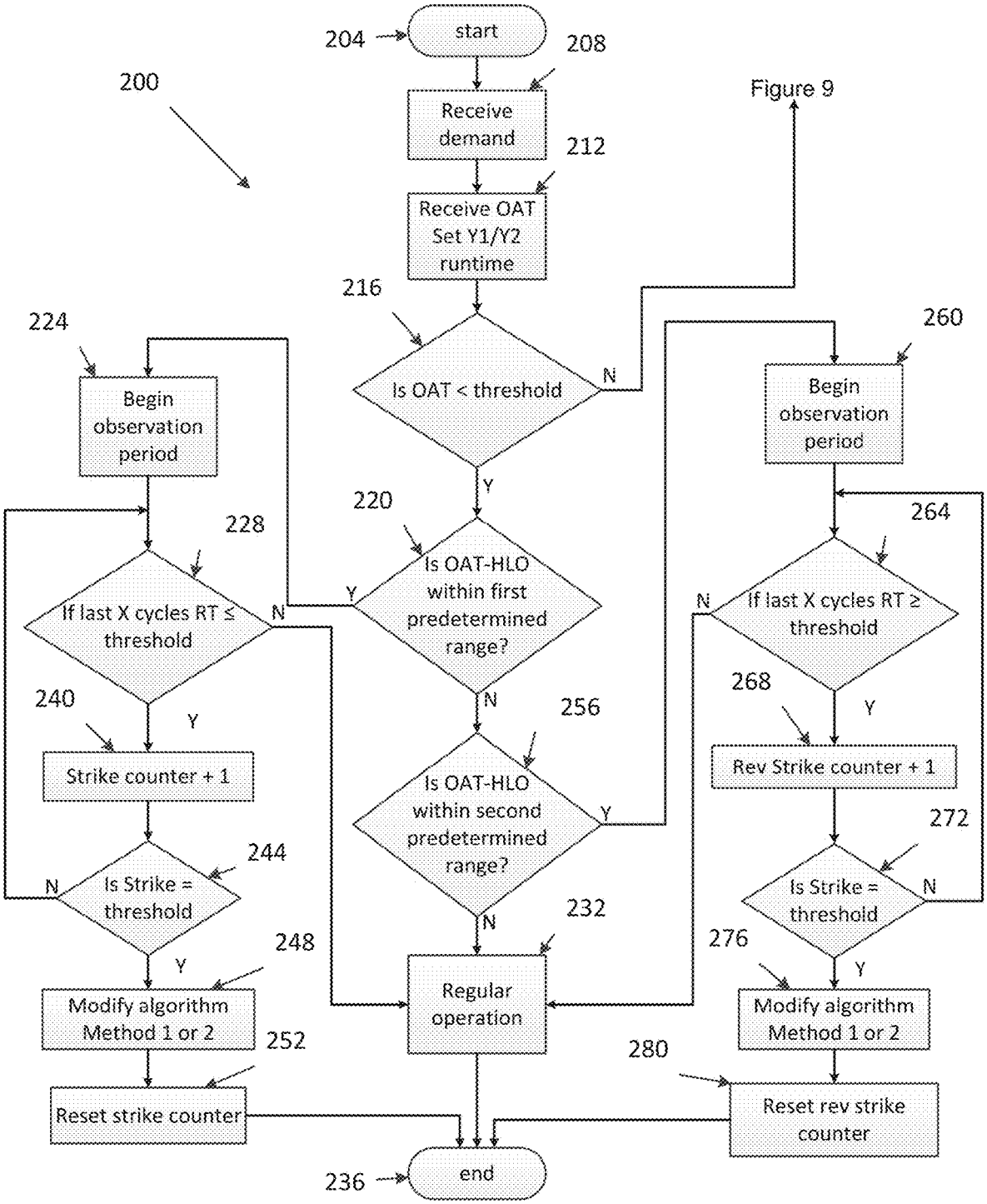
FIGS. 8-9 are a flowchart of another method for controlling a climate-control system according to the present disclosure.
Figure 9:
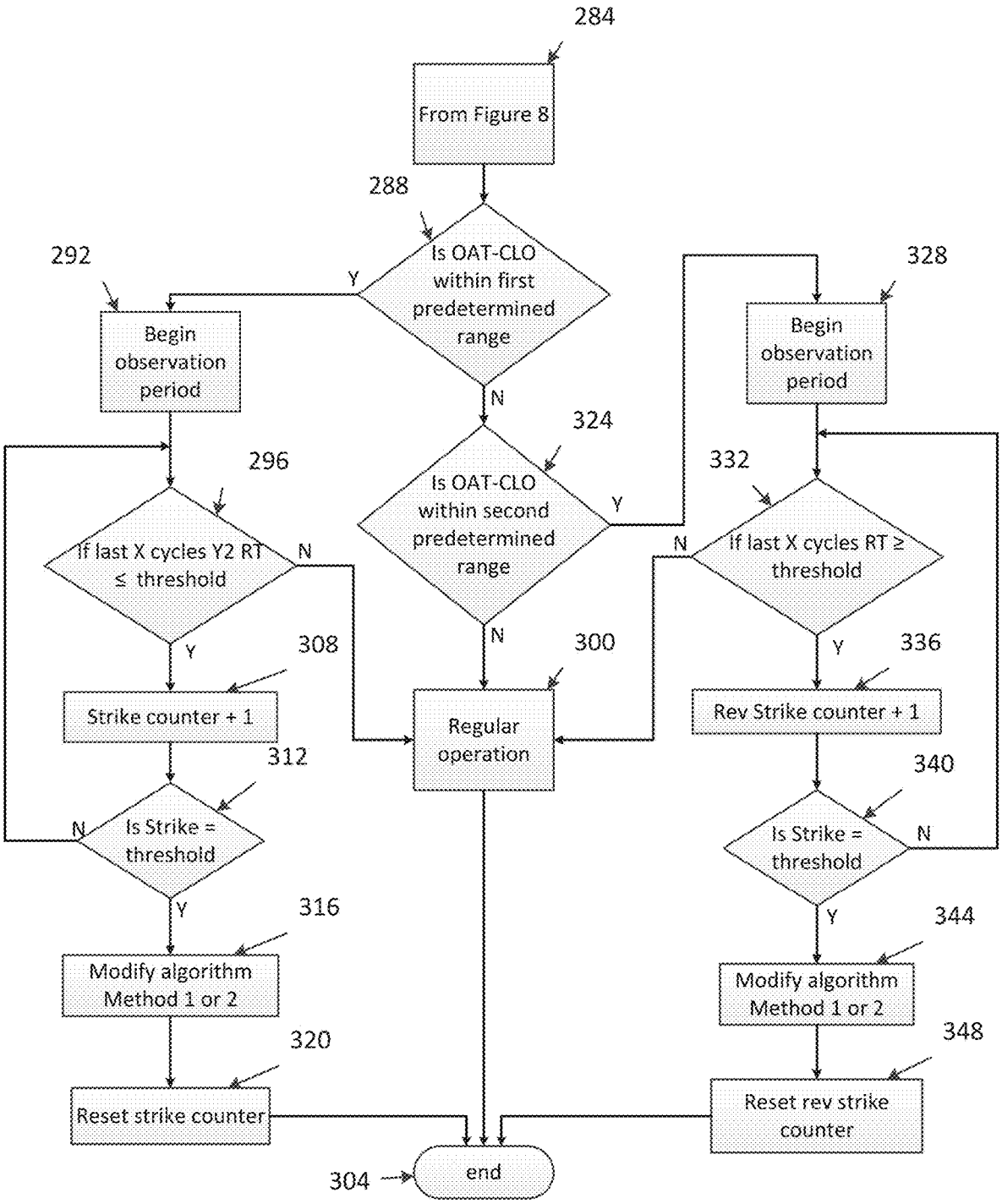

Now referring to FIGS. 8-9, another method 200 for controlling the climate-control system 10 is illustrated. Method 200 may be performed by control module 22 in conjunction with the outdoor ambient temperature sensor 24, the thermostat 26, and the compressor 12. Method 200 starts at 204. At 208, the control module 22 receives a compressor capacity demand. The compressor demand may be sent as a signal from the thermostat 26.

At 212, the control module 22 receives an outdoor ambient temperature and commands the compressor 12 to a low stage or a high stage based on the outdoor ambient temperature. The outdoor ambient temperature may be provided by a signal from the outdoor ambient temperature sensor 24. For example, referring to FIGS. 12A and 12B, example compressor runtime tables are provided. At startup, the control module 22 will command runtimes from the baseline column of the runtime table. Thus, if the outdoor ambient temperature is 75° F., the control module 22 will command the compressor 12 to run at a low capacity stage for 25 minutes. If the demand is still present after 25 minutes, the control module 22 will command the compressor 12 to run at a high capacity stage.

At 216, control module 22 determines whether the outdoor ambient temperature is less than a temperature threshold. The temperature threshold may be set to a temperature where a majority of users do not utilize heating or cooling or a temperature where a majority of users switch from a cooling mode to a heating mode or vice versa. For example only, the temperature threshold may be 65° F.

If the outdoor ambient temperature is less than the temperature threshold, the control module 22 determines a difference between the outdoor ambient temperature and a heating lockout temperature and determines whether the difference is within a first predetermined range at 220. The control module 22 may subtract the heating lockout temperature from the outdoor ambient temperature to determine the difference. For example only, the first predetermined range may be between −10 and 0° F.

If the difference is within the predetermined range at 220, the control module 22 begins an observation period at 224. During the observation period, the control module 22 monitors the cycle runtimes. At 228, the control module 22 determines whether the runtimes for a predetermined number of compressor cycles is less than or equal to a runtime threshold. For example only, the runtime threshold may be 15 minutes/cycle and the predetermined number of compressor cycles may be three. The three compressor cycles may be consecutive cycles or may be three compressor cycles out of a predetermined number, such as five.

If the runtimes for the predetermined number of compressor cycles is not less than or equal to a runtime threshold, the control module 22 proceeds with regular operation at 232. For example, regular operation may be commanding runtimes from the baseline column of the runtime table. Thus, if the outdoor ambient temperature is 45° F., the control module 22 will command the compressor 12 to run at a low capacity stage for 25 minutes. If the demand is still present after 25 minutes, the control module 22 will command the compressor 12 to run at a high capacity stage. The method 200 then ends at 236.

If the runtimes for the predetermined number of compressor cycles is less than or equal to a runtime threshold at 228, the control module 22 adds a strike to a strike counter at 240. If the number of strikes in the strike counter is less than a threshold (for example only, three) at 244, the method 200 returns to 228. If the number of strikes in the strike counter is equal to the threshold (for example only, three) at 244, the control module 22 modifies the control algorithm at 248. For example, the control module 22 may modify the control algorithm by one of the example methods provided in FIGS. 11 and 13 (described below).

At 252, the control module 22 resets the strike counter to zero. At 236, the method 200 ends.

Returning to 220, if the difference is not within the first predetermined range, the control module 22 determines whether the difference is within a second predetermined range at 256. The second predetermined range may be, for example, between 0 and 10° F. If the difference is not within the second predetermined range, the control module 22 proceeds with regular operation at 232. For example, regular operation may be commanding runtimes from the baseline column of the runtime table. Thus, if the outdoor ambient temperature is 45° F., the control module 22 will command the compressor 12 to run at a low capacity stage for 25 minutes. If the demand is still present after 25 minutes, the control module 22 will command the compressor 12 to run at a high capacity stage. The method 200 then ends at 236.

If the difference is within the second predetermined range at 256, the control module 22 begins an observation period at 260. During the observation period, the control module 22 monitors the cycle runtimes. At 264, the control module 22 determines whether the runtimes for a predetermined number of compressor cycles is greater than or equal to a runtime threshold. For example only, the runtime threshold may be 40 minutes/cycle and the predetermined number of compressor cycles may be two. The two compressor cycles may be consecutive cycles or may be two compressor cycles out of a predetermined number, such as three.

If the runtimes for the predetermined number of compressor cycles is not greater than or equal to a runtime threshold, the control module 22 proceeds with regular operation at 232. For example, regular operation may be commanding runtimes from the baseline column of the runtime table. Thus, if the outdoor ambient temperature is 45° F., the control module 22 will command the compressor 12 to run at a low capacity stage for 25 minutes. If the demand is still present after 25 minutes, the control module 22 will command the compressor 12 to run at a high capacity stage. The method 200 then ends at 236.

If the runtimes for the predetermined number of compressor cycles is greater than or equal to the runtime threshold at 264, the control module 22 adds a strike to a reverse strike counter at 268. If the number of strikes in the reverse strike counter is less than a threshold (for example only, two) at 272, the method 200 returns to 264. If the number of strikes in the reverse strike counter is equal to the threshold (for example only, two) at 272, the control module 22 modifies the control algorithm at 276. For example, the control module 22 may modify the control algorithm by one of the example methods provided in FIGS. 11 and 13 (described below).

At 280, the control module 22 resets the reverse strike counter to zero. At 236, the method 200 ends.

Returning to 216, if the outdoor ambient temperature is not less than the temperature threshold, the method 200 moves to 284 in FIG. 9. At 288, the control module 22 determines a difference between the outdoor ambient temperature and a cooling lockout temperature and determines whether the difference is within a first predetermined range. The control module 22 may subtract the cooling lockout temperature from the outdoor ambient temperature to determine the difference. For example only, the first predetermined range may be between 0 and 10° F.

If the difference is within the predetermined range at 288, the control module 22 begins an observation period at 292. During the observation period, the control module 22 monitors the cycle runtimes. At 296, the control module 22 determines whether the runtimes for a predetermined number of compressor cycles is less than or equal to a runtime threshold. For example only, the runtime threshold may be 15 minutes/cycle and the predetermined number of compressor cycles may be three. The three compressor cycles may be consecutive cycles or may be three compressor cycles out of a predetermined number, such as five.

If the runtimes for the predetermined number of compressor cycles is not less than or equal to a runtime threshold, the control module 22 proceeds with regular operation at 300. For example, regular operation may be commanding runtimes from the baseline column of the runtime table. Thus, if the outdoor ambient temperature is 95° F., the control module 22 will command the compressor 12 to run at a high capacity stage. The method 200 then ends at 304.

If the runtimes for the predetermined number of compressor cycles is less than or equal to the runtime threshold at 296, the control module 22 adds a strike to a strike counter at 308. If the number of strikes in the strike counter is less than a threshold (for example only, three) at 312, the method 200 returns to 296. If the number of strikes in the strike counter is equal to the threshold (for example only, three) at 312, the control module 22 modifies the control algorithm at 316. For example, the control module 22 may modify the control algorithm by one of the example methods provided in FIGS. 11 and 13 (described below).

At 320, the control module 22 resets the strike counter to zero. At 304, the method 200 ends.

Returning to 288, if the difference is not within the first predetermined range, the control module 22 determines whether the difference is within a second predetermined range at 324. The second predetermined range may be, for example, between −10 and 0° F. If the difference is not within the predetermined range, the control module 22 proceeds with regular operation at 300. For example, regular operation may be commanding runtimes from the baseline column of the runtime table. Thus, if the outdoor ambient temperature is 75° F., the control module 22 will command the compressor 12 to run at a low capacity stage for 25 minutes. If the demand is still present after 25 minutes, the control module 22 will command the compressor 12 to run at a high capacity stage. The method 200 then ends at 304.

If the difference is within the second predetermined range at 324, the control module 22 begins an observation period at 328. During the observation period, the control module 22 monitors the cycle runtimes. At 332, the control module 22 determines whether the runtimes for a predetermined number of compressor cycles is greater than or equal to a runtime threshold. For example only, the runtime threshold may be 40 minutes/cycle and the predetermined number of compressor cycles may be two. The two compressor cycles may be consecutive cycles or may be two compressor cycles out of a predetermined number, such as three.

If the runtimes for the predetermined number of compressor cycles is not less than or equal to a runtime threshold, the control module 22 proceeds with regular operation at 300. For example, regular operation may be commanding runtimes from the baseline column of the runtime table. Thus, if the outdoor ambient temperature is 75° F., the control module 22 will command the compressor 12 to run at a low capacity stage for 25 minutes. If the demand is still present after 25 minutes, the control module 22 will command the compressor 12 to run at a high capacity stage. The method 200 then ends at 304.

If the runtimes for the predetermined number of compressor cycles is less than or equal to the runtime threshold at 332, the control module 22 adds a strike to a reverse strike counter at 336. If the number of strikes in the reverse strike counter is less than a threshold (for example only, two) at 340, the method 200 returns to 332. If the number of strikes in the reverse strike counter is equal to the threshold (for example only, two) at 340, the control module 22 modifies the control algorithm at 344. For example, the control module 22 may modify the control algorithm by one of the example methods provided in FIGS. 11 and 13 (described below).

At 348, the control module 22 resets the reverse strike counter to zero. At 304, the method 200 ends.

Figure 10:
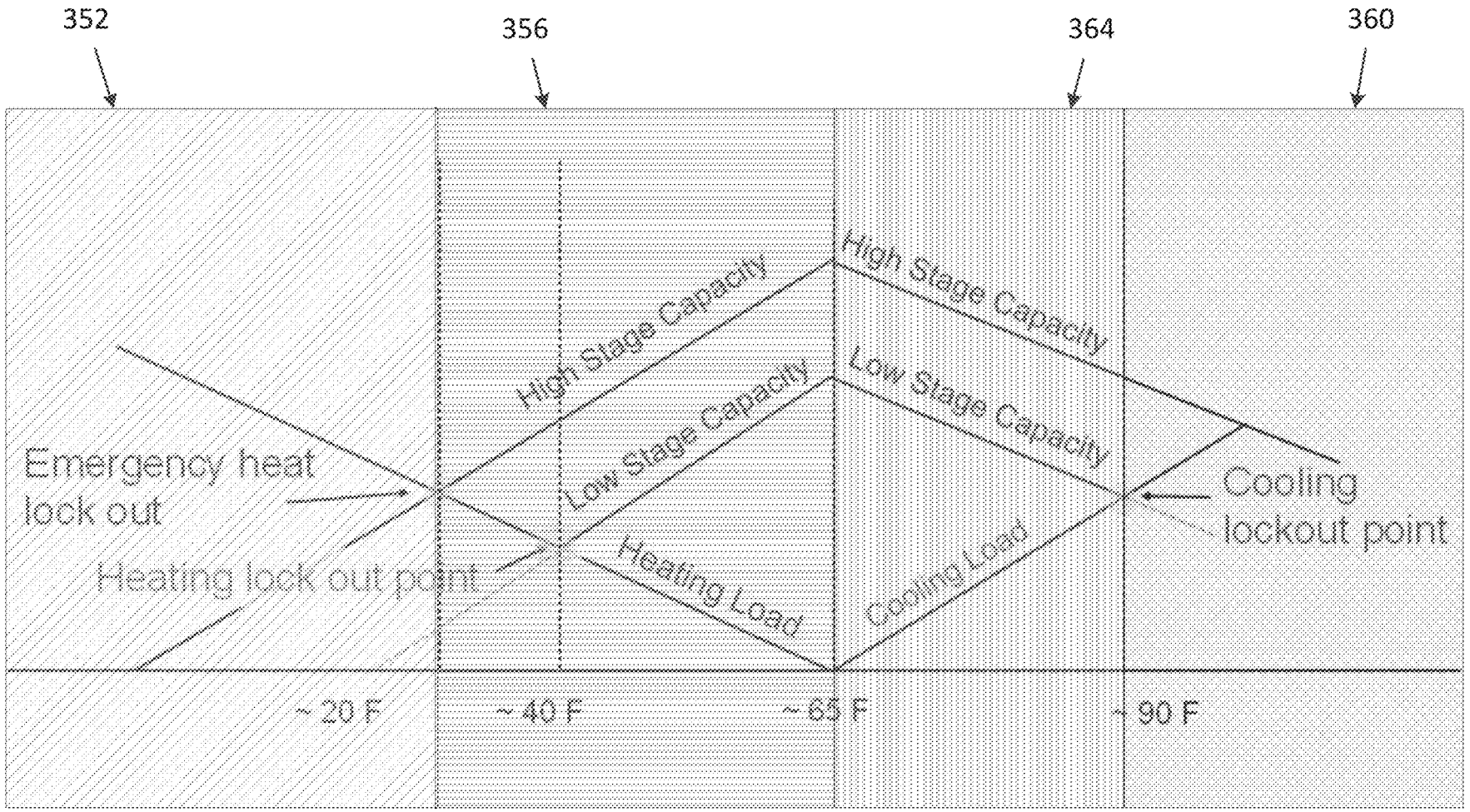
FIG. 10 is a graph of the example control strategy of FIGS. 8-9 incorporating heating and cooling lockout points.
Figure 11:
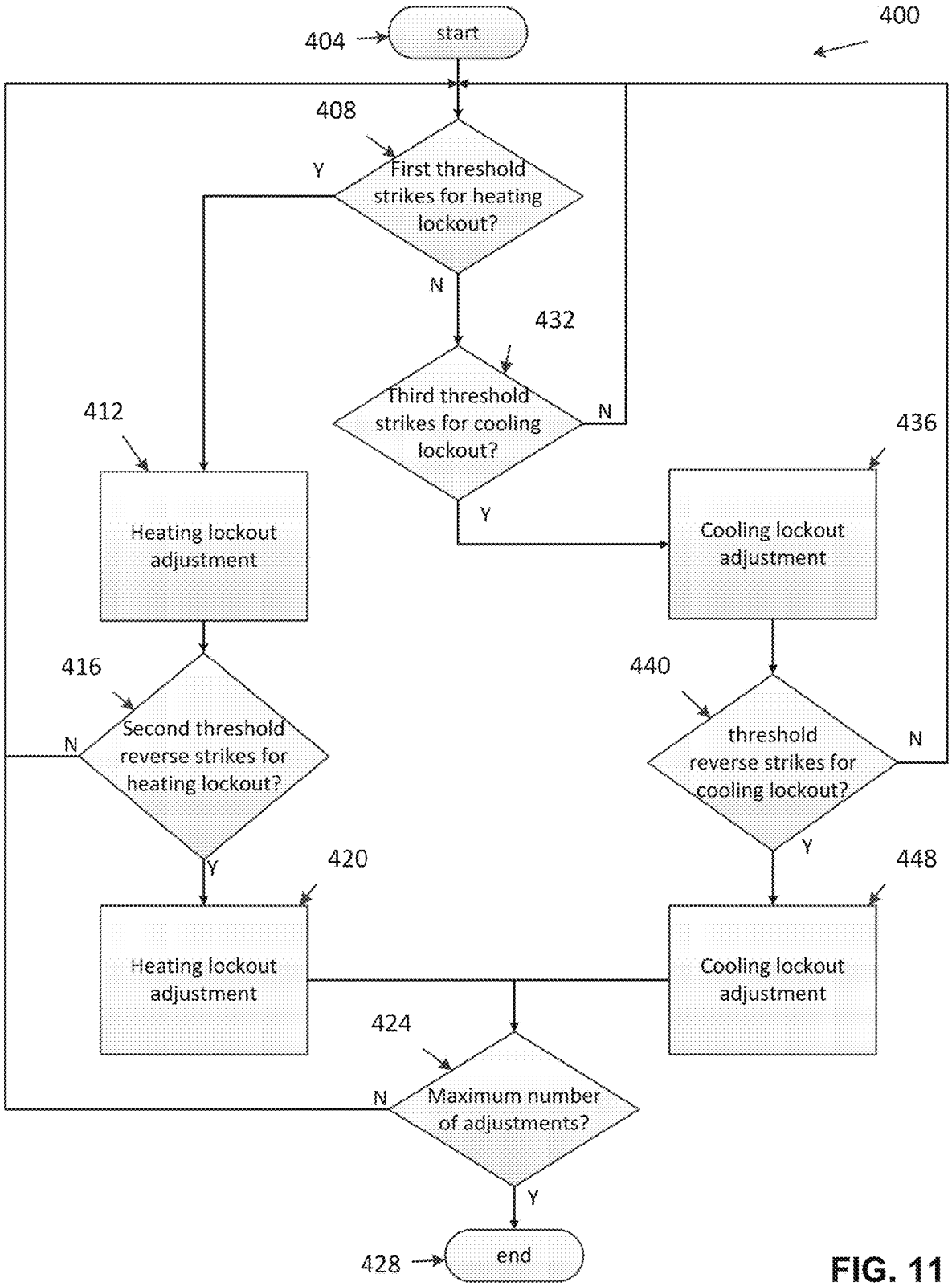
FIG. 11 is a flowchart of an example method of altering or changing a compressor runtime algorithm according to the present disclosure.

Now referring to FIG. 10, the method 200 of FIGS. 8-9 monitors the shaded areas displayed in the graph. The heating cycle (FIG. 8) portion of the method 200 focuses on the shaded blocks 352 and 356, and the cooling cycle (FIG. 9) portion of the method 200 focuses on the shaded blocks 360 and 364. The shaded block 352 includes the temperatures below the emergency heat lockout point (for example only, 30° F.) and is representative of the portion of the method 200 in references 220-252 (FIG. 8). The shaded block 356 includes the temperatures from the heat lockout point to the outdoor ambient temperature threshold (referenced in 216) and is representative of the portion of the method 200 in references 256-280 (FIG. 8). The shaded block 360 includes the temperatures higher than the cooling lockout point (for example only, 90° F.) and is representative of the portion of the method 200 in references 288-320 (FIG. 9). The shaded block 364 includes the temperatures from the cooling lockout point to the outdoor ambient temperature threshold (referenced in 216) and is representative of the portion of the method 200 in references 324-348 (FIG. 9). Thus, the method 200 covers the entire range in temperatures.

FIGS. 11-14 provide example methods of changing the compressor runtime algorithm as referenced in methods 100 and 200 (FIGS. 6, 8, and 9). Now referring to FIG. 11, a flowchart for an example method 400 of altering or changing a compressor runtime algorithm is illustrated. Method 400 may be performed by control module 22. Method 400 begins at 404. At 408, the control module 22 determines whether there have been a first threshold number of strikes for the heating lockout. Each strike may be accumulated as previously described with respect to FIGS. 6, 8, and 9. For example only, the first threshold number of strikes may be three strikes for the heating lockout.

If there have been the threshold number of strikes for the heating lockout, the control module 22 makes a heating lockout adjustment at 412. For example, with respect to the table in FIG. 12A, a value in the heating lockout adjustment column is added to a value in a Y1 (demand for compressor 1) run time column to change the temperature of the heating lockout. If the compressor 12 is running in the baseline runtime column, the compressor 12 will operate at the requested demand (Y1 demand) for a run time (in the baseline RT column) corresponding to the outside ambient temperature (for example, 20 minutes at an OAT of 40-45° F.). If three strikes are accumulated, the value from the heating lockout adjustment column is added to the baseline run time (RT) column to equate the adjacent Y1 RT+adj. value column. Then the compressor 12 operates at the requested demand (Y1 demand) for a run time corresponding to the outside ambient temperature (for example, 30 minutes at an OAT of 40-45° F.). Each time the control module 22 adjusts the heating lockout at 412, the compressor 12 will operate for a run time in an adjacent Y1 RT+adj. value column to the right of the previous column in the "heating season" section.

At 416, the control module 22 determines whether there have been a second threshold number of reverse strikes for the heating lockout. Each reverse strike may be accumulated as previously described with respect to FIGS. 8 and 9. The second threshold number of reverse strikes may be the same as or different than the first threshold number of strikes. For example only, the second threshold number of reverse strikes may be two strikes for the heating lockout.

If there have not been the second threshold number of reverse strikes, method 400 returns to 408. If there have been the second threshold number of reverse strikes at 416, control module 22 makes a heating lockout adjustment at 420. For example, with respect to the table in FIG. 12B, the heating lockout column is subtracted from the current Y1 RT+adj. value column to change the temperature of the heating lockout. If the compressor 12 is running in the first Y1 RT+adj. value column, the compressor 12 will operate at the requested demand (Y1 demand) for a run time corresponding to the outside ambient temperature (for example, 30 minutes at an OAT of 40-45° F.). If two reverse strikes are accumulated, the value from the heating lockout adjustment column is subtracted from the Y1 RT+adj. value column to equate the Baseline RT column. Then the compressor 12 operates at the requested demand (Y1 demand) for a run time corresponding to the outside ambient temperature (for example, 20 minutes at an OAT of 40-45° F.). Each time the control module 22 adjusts the heating lockout at 420, the compressor 12 will operate for a run time in the adjacent Y1 RT+adj. value column or Baseline RT column to the left of the previous column in the "heating season" section.

At 424, the control module 22 determines whether a maximum number of adjustments have been made. For example, the method 400 may be limited to a maximum of three adjustments. The maximum allowed adjustments may be implemented to prevent the compressor run table from being adjusted too far from the Baseline RT.

If the maximum number of adjustments has not been made, method 400 returns to 408. If the maximum number of adjustments has been made at 424, the method 400 ends at 428. For example, if the maximum adjustments have been made, the system continues operating, but no further adjustments will be made until a reverse strike occurs.

Returning to 408, if the first threshold number of strikes for the heating lockout have not been met, the control module 22 determines whether a third threshold number of strikes for the cooling lockout have been met. Each strike may be accumulated as previously described with respect to FIGS. 6, 8, and 9. The third threshold number of strikes may be the same as or different than the first threshold number of strikes and/or the second threshold number of reverse strikes. For example only, the third threshold number of strikes may be three strikes for the cooling lockout.

If the third threshold number of strikes for the cooling lockout have not been met, method 400 returns to 408. If there have been the third threshold number of strikes for the cooling lockout at 432, the control module 22 makes a cooling lockout adjustment at 436. For example, with respect to the table in FIG. 12A, a cooling lockout column is added to the current Y1 RT column to change the temperature of the cooling lockout. If the compressor 12 is running in the Baseline RT (run time) column, the compressor 12 will operate at the requested demand (Y1 demand) for a run time (in the baseline RT column) corresponding to the outside ambient temperature (for example, 20 minutes at an OAT of 80-85° F.). If three strikes are accumulated, the value from the cooling lockout adjustment column is added to the Baseline RT column to equate the first Y1 RT+adj. value column in the Cooling Season section. Then the compressor 12 operates at the requested demand (Y1 demand) for a run time corresponding to the outside ambient temperature (for example, 30 minutes at an OAT of 80-85° F.). Each time the control module 22 adjusts the cooling lockout at 436, the compressor 12 will operate for a run time in an adjacent Y1 RT+adj. value column to the right of the previous column in the Cooling Season section.

At 440, the control module 22 determines whether there have been a fourth threshold number of reverse strikes for the cooling lockout. Each reverse strike may be accumulated as previously described with respect to FIGS. 6, 8, and 9. The fourth threshold number of reverse strikes may be the same as or different than the first threshold number of strikes, the second threshold number of reverse strikes, or the third threshold number of strikes. For example only, the fourth threshold number of reverse strikes may be two strikes for the cooling lockout.

If there have not been the fourth threshold number of reverse strikes, method 400 returns to 408. If there have been the fourth threshold number of reverse strikes at 440, control module 22 makes a cooling lockout adjustment at 448. For example, with respect to the table in FIG. 12B, the cooling lockout adjustment column is subtracted from the Y1 RT+adj. value column to change the temperature of the cooling lockout. If the compressor 12 is running in the first Y1 RT+adj. value column in the Cooling Season section, the compressor 12 will operate at the requested demand (Y1 demand) for a run time corresponding to the outside ambient temperature (for example, 30 minutes at an OAT of 80-85° F.). If two reverse strikes are accumulated, the value from the cooling lockout adjustment column is subtracted from the current Y1 RT+adj. value column to equate the Baseline RT column. Then the compressor 12 operates at the requested demand (Y1 demand) for a run time corresponding to the outside ambient temperature (for example, 20 minutes at an OAT of 80-85° F.). Each time the control module 22 adjusts the cooling lockout at 448, the compressor 12 will operate for a run time in the adjacent Y1 RT+adj. value column or Baseline RT column to the left of the previous column in the "cooling season" section.

At 424, the control module 22 determines whether a maximum number of adjustments have been made. For example, the method 400 may be limited to a maximum of three adjustments. The maximum allowed adjustments may be implemented to prevent the compressor run table from being adjusted too far from the Baseline RT.

If the maximum number of adjustments has not been made, method 400 returns to 408. If the maximum number of adjustments has been made at 424, the method 400 ends at 428. For example, if the maximum adjustments have been made, the system continues operating, but no further adjustments will be made until a reverse strike occurs.

Now referring to FIGS. 12A and 12B, the previously mentioned run time tables will be further discussed. The table in FIG. 12A corresponds to the previously-described strikes, while the table in FIG. 12B corresponds to the previously-described reverse strikes. Each table provides compressor run times for the various outdoor ambient temperatures (OAT) provided in the column on the far left. A Baseline RT (run time) column is provided adjacent to the OAT column. The Baseline RT column may correspond to generic run times for all compressors across the country or market region or may be recommended run times for a specific region or facility type (i.e., commercial, residential, etc.). The following three columns to the right of the Baseline RT column are adjustments for the Heating Season (for example, when the temperature is less than 65° F.), and the three columns to the right of the Heating Season section are adjustments for the Cooling Season (for example, when the temperature is greater than 65° F.). The two columns on the far right are the heating lockout adjustment column and the cooling lockout adjustment column which are added to the Baseline RT column in various scenarios to create the adjustment columns in the Heating Season section and the Cooling season section. During the reverse strike scenario, the values in the heating lockout adjustment column and the cooling lockout adjustment column may also be subtracted from the columns in the Heating Season section and the Cooling season section to move between the adjustment columns and Baseline RT column.

The darker shaded portion in the temperature range of 85-105° F. represents the cooling lockout temperatures. When the temperature falls within the cooling lockout temperature section, the compressor is locked in high and cannot be adjusted. The cooling lockout is designed to fall in temperature ranges where maximum cooling is desired. The lighter shaded portion in the temperature range of 20-35° F. represents the heating lockout temperatures. When the temperature falls within the heating lockout temperature section, the compressor is locked in high and cannot be adjusted. The heating lockout is designed to fall in temperature ranges where maximum heating is desired.

Figure 13:
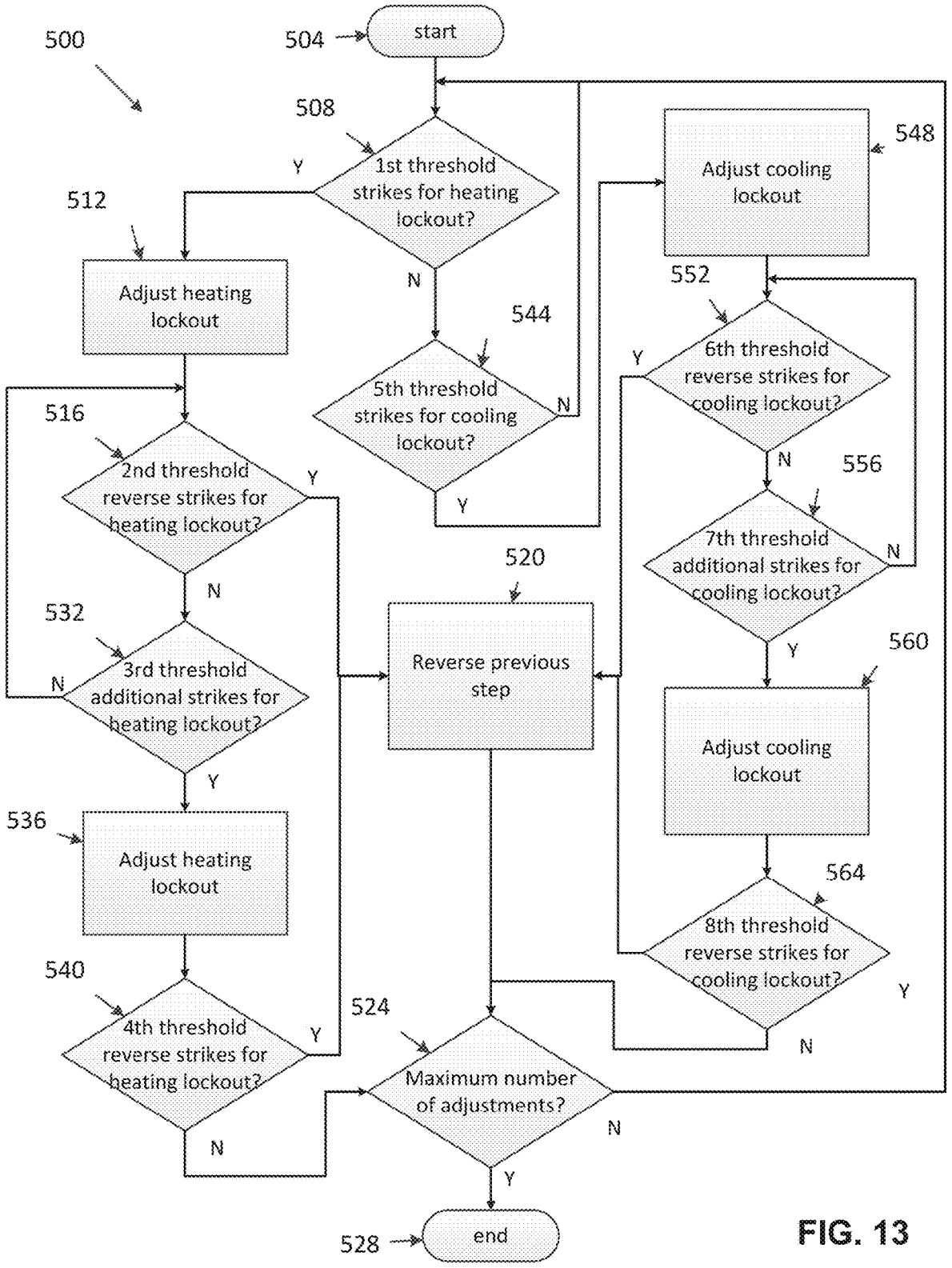
FIG. 13 is a flowchart of another example method of altering or changing a compressor runtime algorithm according to the present disclosure.

Now referring to FIG. 13, a flowchart for another example method 500 of altering or changing a compressor runtime algorithm is illustrated. Method 500 may be performed by control module 22. Method 500 begins at 504. At 508, the control module 22 determines whether there have been a first threshold number of strikes for the heating lockout. Each strike may be accumulated as previously described with respect to FIGS. 6, 8, and 9. For example only, the first threshold number of strikes may be three strikes for the heating lockout.

If there have been the threshold number of strikes for the heating lockout, the control module 22 makes a heating lockout adjustment at 512. For example, with respect to the table in FIG. 14, a predetermined number of minutes (for example, 10 minutes) is added to a value in a Y1 (demand for compressor 1) run time column in the heating lockout row to change the temperature of the heating lockout. The heating lockout row may be the top row of a shaded area or the first 0 or negative time in the column. For example, if the compressor 12 is running in the baseline runtime column, the compressor 12 will operate at the requested demand (Y1 demand) for a run time (in the baseline RT column) corresponding to the outside ambient temperature (for example, 20 minutes at an OAT of 40-45° F.). If the threshold number of strikes are accumulated, a predetermined time, for example 10 minutes, are added to the baseline run time (RT) value at the lockout row (i.e., 10 minutes is added to 0 minutes) to equate the adjacent Y1 RT+adj. value column and adjust the lockout temperature. Then the compressor 12 operates at the requested demand (Y1 demand) for a run time corresponding to the outside ambient temperature (for example, 20 minutes at an OAT of 40-45° F.).

At 516, the control module 22 determines whether there have been a second threshold number of reverse strikes for the heating lockout. Each reverse strike may be accumulated as previously described with respect to FIGS. 6, 8, and 9. The second threshold number of reverse strikes may be the same as or different than the first threshold number of strikes. For example only, the second threshold number of reverse strikes may be two strikes for the heating lockout.

If there have been the second threshold number of reverse strikes, method 500 reverses the previous step (i.e., the previous adjustment from 512) at 520. At 524, the control module 22 determines whether a maximum number of adjustments have been made. For example, the method 500 may be limited to a maximum of three adjustments. The maximum allowed adjustments may be implemented to prevent the compressor run table from being adjusted too far from the Baseline RT.

If the maximum number of adjustments has not been made, method 500 returns to 508. If the maximum number of adjustments has been made at 524, the method 500 ends at 528.

Returning to 516, if the second threshold number of reverse strikes at 516 have not been met, control module 22 determines whether an additional number of strikes meets a third threshold at 532. The third threshold may or may not be equal to first threshold and/or the second threshold. For example, the third threshold may be three strikes. If the additional number of strikes has not met the third threshold, the method 500 returns to 516.

If the additional number of strikes meets the third threshold at 532, the control module 22 makes a second heating lockout adjustment at 536. For example, with respect to the table in FIG. 14, the heating lockout column is added to the Y1 RT+adj. value column to change the temperature of the heating lockout. If the compressor 12 is running in the first Y1 RT+adj. value column, the compressor 12 will operate at the requested demand (Y1 demand) for a run time corresponding to the outside ambient temperature (for example, 10 minutes at an OAT of 35-40° F.). If the additional number of strikes (for example, three) are accumulated, the value from the heating lockout adjustment column is added to the Y1 RT+adj. value column to equate the Y1 RT+adj. value column to the right. Then the compressor 12 operates at the requested demand (Y1 demand) for a run time corresponding to the outside ambient temperature (for example, 20 minutes at an OAT of 35-40° F.).

At 540, the control module 22 determines whether there have been a fourth threshold number of reverse strikes. The fourth threshold may or may not be equal to the third threshold, the second threshold, and/or the first threshold. For example, the fourth threshold number of reverse strikes may be two reverse strikes. If true at 540, method 500 reverses the previous step (i.e., the previous adjustment from 536) at 520. At 524, the control module 22 determines whether a maximum number of adjustments have been made. For example, the method 500 may be limited to a maximum of three adjustments. The maximum allowed adjustments may be implemented to prevent the compressor run table from being adjusted too far from the Baseline RT.

If the maximum number of adjustments has not been made, method 500 returns to 508. If the maximum number of adjustments has been made at 524, the method 500 ends at 528.

Returning to 540, if false (i.e., if there have not been the fourth threshold number of reverse strikes), the control module 22 determines whether a maximum number of adjustments have been made at 524. For example, the method 500 may be limited to a maximum of three adjustments. The maximum allowed adjustments may be implemented to prevent the compressor run table from being adjusted too far from the Baseline RT.

If the maximum number of adjustments has not been made, method 500 returns to 508. If the maximum number of adjustments has been made at 524, the method 500 ends at 528.

Returning to 508, if the first threshold number of strikes for the heating lockout have not been met, the control module 22 determines whether a fifth threshold number of strikes for the cooling lockout have been met at 544. Each strike may be accumulated as previously described with respect to FIGS. 6, 8, and 9. The fifth threshold number of strikes may be the same as or different than one or more of the first through fourth threshold number of strikes and/or reverse strikes. For example only, the fifth threshold number of strikes may be three strikes for the cooling lockout.

If the fifth threshold number of strikes for the cooling lockout have not been met, method 500 returns to 508. If there have been the fifth threshold number of strikes for the cooling lockout at 544, the control module 22 makes a cooling lockout adjustment at 548. For example, with respect to the table in FIG. 14, a predetermined number of minutes (for example, 10 minutes) is added to a value in a Y1 (demand for compressor 1) run time column in the cooling lockout row to change the temperature of the cooling lockout. The cooling lockout row may be the bottom row of a shaded area or the first 0 or negative time in the column. For example, if the compressor 12 is running in the baseline runtime column, the compressor 12 will operate at the requested demand (Y1 demand) for a run time (in the baseline RT column) corresponding to the outside ambient temperature (for example, 20 minutes at an OAT of 80-85° F.). If the threshold number of strikes are accumulated, a predetermined time, for example 10 minutes, is added to the baseline run time (RT) value at the lockout row (i.e., 10 minutes is added to 0 minutes) to equate the adjacent Y1 RT+adj. value column and adjust the lockout temperature. Then the compressor 12 operates at the requested demand (Y1 demand) for a run time corresponding to the outside ambient temperature (for example, 10 minutes at an OAT of 85-90° F.).

At 552, the control module 22 determines whether there have been a sixth threshold number of reverse strikes for the cooling lockout. Each reverse strike may be accumulated as previously described with respect to FIGS. 6, 8, and 9. The sixth threshold number of reverse strikes may be the same as or different than one or more of the first through fifth threshold number of strikes or reverse strikes. For example only, the sixth threshold number of reverse strikes may be two strikes for the cooling lockout.

If there have been the sixth threshold number of reverse strikes, method 500 reverses the previous step (i.e., the previous adjustment from 548) at 520. At 524, the control module 22 determines whether a maximum number of adjustments have been made. For example, the method 500 may be limited to a maximum of three adjustments. The maximum allowed adjustments may be implemented to prevent the compressor run table from being adjusted too far from the Baseline RT.

If the maximum number of adjustments has not been made, method 500 returns to 508. If the maximum number of adjustments has been made at 524, the method 500 ends at 528.

Returning to 552, if the sixth threshold number of reverse strikes have not been met, control module 22 determines whether an additional number of strikes meets a seventh threshold at 556. The seventh threshold may or may not be equal to one or more of the first through fifth thresholds. For example, the seventh threshold may be three strikes. If the additional number of strikes has not met the seventh threshold, the method 500 returns to 552.

If the additional number of strikes meets the seventh threshold at 556, the control module 22 makes a second cooling lockout adjustment at 560. For example, with respect to the table in FIG. 14, the cooling lockout adjustment column is added to the Y1 RT+adj. value column to change the temperature of the cooling lockout. If the compressor 12 is running in the first Y1 RT+adj. value column, the compressor 12 will operate at the requested demand (Y1 demand) for a run time corresponding to the outside ambient temperature (for example, 10 minutes at an OAT of 85-90° F.). If the additional number of strikes (for example, three) are accumulated, the value from the cooling lockout adjustment column is added to the Y1 RT+adj. value column to equate the Y1 RT+adj. value column to the right. Then the compressor 12 operates at the requested demand (Y1 demand) for a run time corresponding to the outside ambient temperature (for example, 20 minutes at an OAT of 85-90° F.).

At 564, the control module 22 determines whether there have been an eighth threshold number of reverse strikes. The eighth threshold may or may not be equal to one or more of the first through seventh thresholds. For example, the eighth threshold number of reverse strikes may be two reverse strikes. If true at 564, method 500 reverses the previous step (i.e., the previous adjustment from 560) at 520. At 524, the control module 22 determines whether a maximum number of adjustments have been made. For example, the method 500 may be limited to a maximum of three adjustments. The maximum allowed adjustments may be implemented to prevent the compressor run table from being adjusted too far from the Baseline RT.

If the maximum number of adjustments has not been made, method 500 returns to 508. If the maximum number of adjustments has been made at 524, the method 500 ends at 528.

Returning to 564, if false (i.e., if there have not been the eighth threshold number of reverse strikes), the control module 22 determines whether a maximum number of adjustments have been made at 524. For example, the method 500 may be limited to a maximum of three adjustments. The maximum allowed adjustments may be implemented to prevent the compressor run table from being adjusted too far from the Baseline RT.

If the maximum number of adjustments has not been made, method 500 returns to 508. If the maximum number of adjustments has been made at 524, the method 500 ends at 528.

Now referring to FIG. 14, the previously mentioned run time table will be further discussed. The table provides compressor run times for the various outdoor ambient temperatures (OAT) provided in the column on the far left. A Baseline RT (run time) column is provided adjacent to the OAT column. The Baseline RT column may correspond to generic run times for all compressors across the country or market region or may be recommended run times for a specific region or facility type (i.e., commercial, residential, etc.). The following three columns to the right of the Baseline RT column are adjustments for the Heating Season (for example, when the temperature is greater than 65° F.), and the three columns to the right of the Heating Season section are adjustments for the Cooling Season (for example, when the temperature is less than 65° F.). The two columns on the far right are the heating lockout adjustment column and the cooling lockout adjustment column which are added to the Baseline RT column in various scenarios to create the adjustment columns in the Heating Season section and the Cooling season section.

The darker shaded portion in the temperature range of 85-105° F. represents the cooling lockout temperatures. When the temperature falls within the cooling lockout temperature section, the compressor is locked in high and cannot be adjusted. The cooling lockout is designed to fall in temperature ranges where maximum cooling is desired. The lighter shaded portion in the temperature range of 20-35° F. represents the heating lockout temperatures. When the temperature falls within the heating lockout temperature section, the compressor is locked in high and cannot be adjusted. The heating lockout is designed to fall in temperature ranges where maximum heating is desired.

Two out of three of the columns in each of the Heating Season section and the Cooling Season section are columns where a predetermined time has been added to the time in the heating lockout our cooling lockout temperature. For example, in the Baseline RT column, the heating lockout temperature is 35-40° F. (because it is the first shaded box) and the cooling lockout temperature is 85-90° F. (because it is the first shaded box). As evident by the first Y1 RT+adj. value column of the Heating Season section, a predetermined time, for example 10 minutes, has been added to the 0 minute Baseline RT value. Likewise, in the first Y1 RT+adj. value column of the Cooling Season section, the predetermined time, for example 10 minutes, has been added to the 0 minute Baseline RT value. If another round of threshold strikes are accumulated, the heating lockout adjustment column or cooling lockout adjustment column is added to the respective Y1 RT+adj. value column, as previously discussed.

Figure 15:
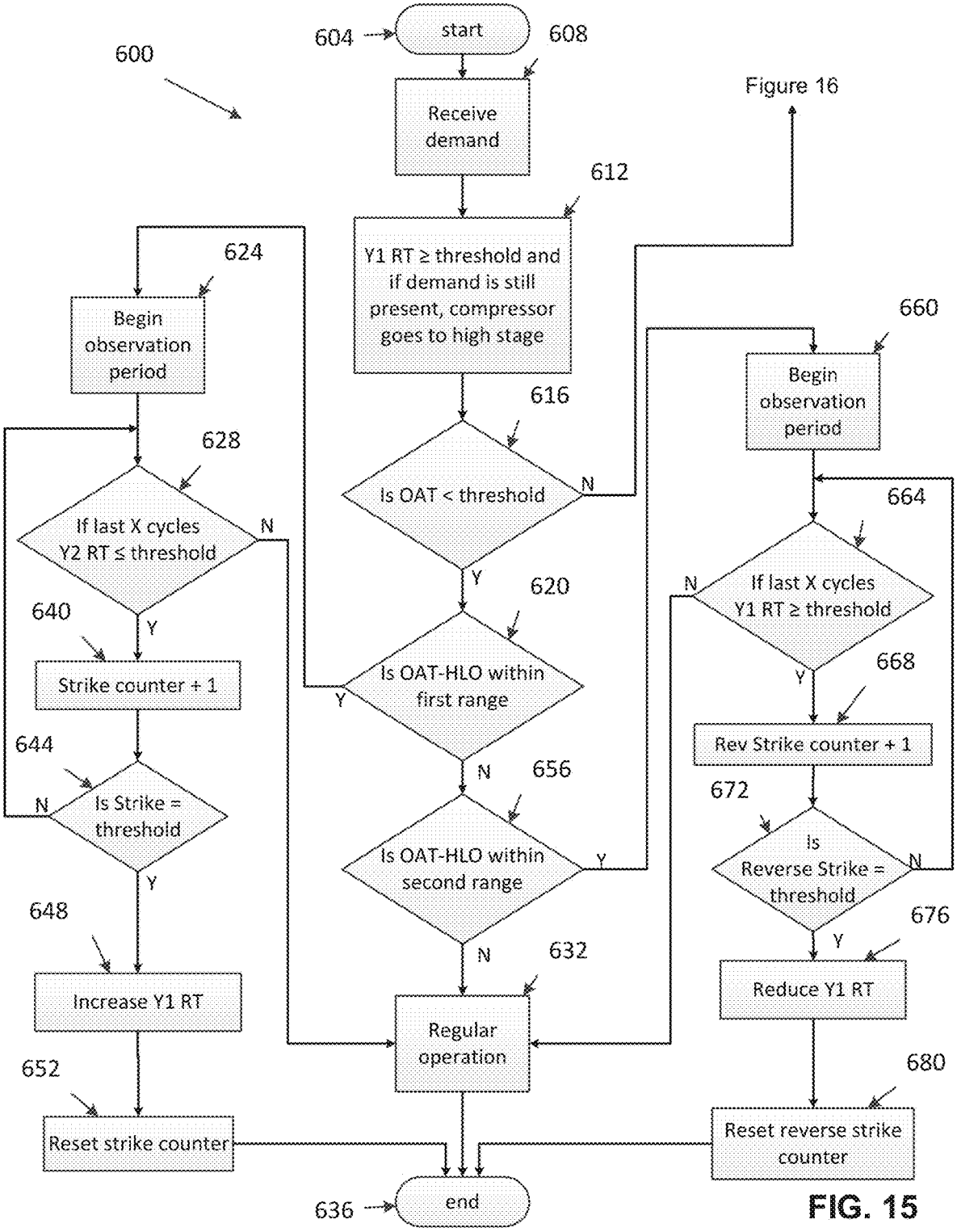
FIGS. 15-16 are a flowchart of another method for controlling a climate-control system according to the present disclosure.
Figure 16:
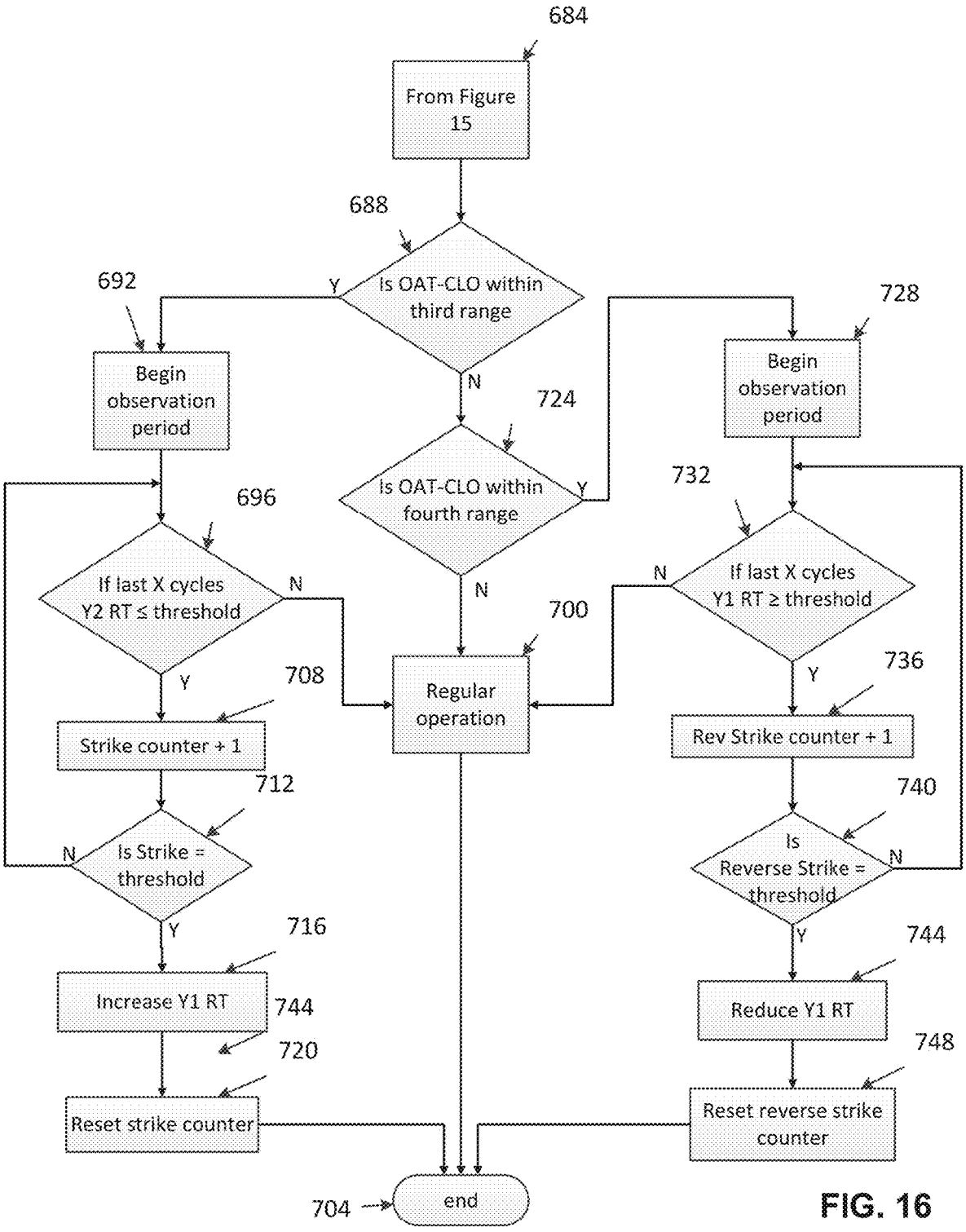

Now referring to FIGS. 15-16, another method 600 for controlling the climate-control system 10 is illustrated. Method 600 may be performed by control module 22 in conjunction with the outdoor ambient temperature sensor 24, the thermostat 26, and the compressor 12. Method 600 starts at 604. At 608, the control module 22 receives a compressor capacity demand. The compressor demand may be sent as a signal from the thermostat 26.

At 612, the control module 22 receives an outdoor ambient temperature and commands the compressor 12 to a low stage or a high stage based on the outdoor ambient temperature. The outdoor ambient temperature may be provided by a signal from the outdoor ambient temperature sensor 24. For example, if the outdoor ambient temperature is 75° F., the control module 22 may command the compressor 12 to run at a low capacity stage for 20 minutes. If the demand is still present after 20 minutes, the control module 22 may command the compressor 12 to run at a high capacity stage.

At 616, control module 22 determines whether the outdoor ambient temperature is less than a temperature threshold. The temperature threshold may be set to a temperature where a majority of users do not utilize heating or cooling or a temperature where a majority of users switch from a cooling mode to a heating mode or vice versa. For example only, the temperature threshold may be 65° F.

If the outdoor ambient temperature is less than the temperature threshold, the control module 22 determines a difference between the outdoor ambient temperature and a heating lockout temperature and determines whether the difference is within a first predetermined range at 620. The heating lockout temperature may be preset at, for example, 40° F. The control module 22 may subtract the heating lockout temperature from the outdoor ambient temperature to determine the difference. For example only, the first predetermined range may be between −10 and 0° F.

If the difference is within the predetermined range at 620, the control module 22 begins an observation period at 624. During the observation period, the control module 22 monitors the cycle runtimes. At 628, the control module 22 determines whether the runtimes for a predetermined number of high compressor cycles is less than or equal to a runtime threshold. For example only, the runtime threshold may be 15 minutes/cycle and the predetermined number of high compressor cycles may be three. The three compressor cycles may be consecutive cycles or may be three compressor cycles out of a predetermined number, such as five. For example, if the compressor 12 cycled from off or low stage to high stage (for less than 15 minutes) to off or low stage three consecutive times, the threshold in 628 would be met.

If the runtimes for the predetermined number of high compressor cycles is not less than or equal to a runtime threshold, the control module 22 proceeds with regular operation at 632. For example, regular operation may be commanding a runtime of 20 minutes and if the compressor demand is still present, switching the compressor to a high stage until the compressor demand is met. The method 600 then ends at 636.

If the runtimes for the predetermined number of high compressor cycles is less than or equal to the runtime threshold at 628, the control module 22 adds a strike to a strike counter at 640. If the number of strikes in the strike counter is less than a threshold (for example only, three) at 644, the method 600 returns to 628. If the number of strikes in the strike counter is equal to the threshold (for example only, three) at 644, the control module 22 modifies the control algorithm at 648. For example, the control module 22 may modify the control algorithm by increasing the run time at low capacity by five minutes. Thus, instead of commanding a runtime of 20 minutes and if the compressor demand is still present, switching the compressor to a high stage until the compressor demand is met, the control module 22 will command a run time of 25 minutes and if the compressor demand is still present, the control module 22 will then switch the compressor to a high stage until the compressor demand is met.

At 652, the control module 22 resets the strike counter to zero. At 636, the method 600 ends.

Returning to 620, if the difference is not within the first predetermined range, the control module 22 determines whether the difference is within a second predetermined range at 656. For example only, the second predetermined range may be between 0 and 10° F. If the difference is not within the second predetermined range, the control module proceeds with regular operation at 632. For example, regular operation may be commanding a runtime of 20 minutes and if the compressor demand is still present, switching the compressor to a high stage until the compressor demand is met. The method 600 then ends at 636.

If the difference is within the second predetermined range at 656, the control module 22 begins an observation period at 660. During the observation period, the control module 22 monitors the cycle runtimes. At 664, the control module 22 determines whether the runtimes for a predetermined number of low compressor cycles is less than or equal to a runtime threshold. For example only, the runtime threshold may be 40 minutes/cycle and the predetermined number of compressor cycles may be two. The two compressor cycles may be consecutive cycles or may be two compressor cycles out of a predetermined number, such as three. For example, if the compressor cycled from off to low stage (for at least 40 minutes) to off twice, the threshold of 664 would be met.

If the runtimes for the predetermined number of low compressor cycles is not less than or equal to the runtime threshold, the control module 22 proceeds with regular operation at 632. For example, regular operation may be commanding a runtime of 20 minutes and if the compressor demand is still present, switching the compressor to a high stage until the compressor demand is met. The method 600 then ends at 636.

If the runtimes for the predetermined number of low compressor cycles is less than or equal to the runtime threshold at 664, the control module 22 adds a reverse strike to a reverse strike counter at 668. If the number of reverse strikes in the reverse strike counter is less than a threshold (for example only, two) at 672, the method 600 returns to 664. If the number of reverse strikes in the reverse strike counter is equal to the threshold (for example only, two) at 672, the control module 22 modifies the control algorithm at 676. For example, the control module 22 may modify the control algorithm by reducing the run time at low capacity by five minutes. Thus, instead of commanding a runtime of 40 minutes and if the compressor demand is still present, switching the compressor to a high stage until the compressor demand is met, the control module 22 will command a run time of 35 minutes and if the compressor demand is still present, the control module 22 will then switch the compressor to a high stage until the compressor demand is met.

At 680, the control module 22 resets the reverse strike counter to zero. At 636, the method 600 ends.

Returning to 616, if the outdoor ambient temperature is not less than the temperature threshold, the method 600 moves to 684 (FIG. 16). At 688, the control module 22 determines a difference between the outdoor ambient temperature and a cooling lockout temperature and determines whether the difference is within a third predetermined range. The cooling lockout temperature may be preset at, for example, 80° F. The control module 22 may subtract the cooling lockout temperature from the outdoor ambient temperature to determine the difference. For example only, the third predetermined range may be between 0 and 10° F.

If the difference is within the predetermined range at 688, the control module 22 begins an observation period at 692. During the observation period, the control module 22 monitors the cycle runtimes. At 696, the control module 22 determines whether the runtimes for a predetermined number of high compressor cycles is less than or equal to a runtime threshold. For example only, the runtime threshold may be 15 minutes/cycle and the predetermined number of compressor cycles may be three. The three compressor cycles may be consecutive cycles or may be three compressor cycles out of a predetermined number, such as five. For example, if the compressor cycles from low stage or off to high stage (for less than 15 minutes) to low stage or off three times, the threshold at 696 would be met.

If the runtimes for the predetermined number of high compressor cycles is not less than or equal to a runtime threshold, the control module 22 proceeds with regular operation at 700. For example, regular operation may be commanding a runtime of 20 minutes and if the compressor demand is still present, switching the compressor to a high stage until the compressor demand is met. The method 600 then ends at 704.

If the runtimes for the predetermined number of high compressor cycles is less than or equal to the runtime threshold at 696, the control module 22 adds a strike to a strike counter at 708. If the number of strikes in the strike counter is less than a threshold (for example only, three) 712, the method 600 returns to 696. If the number of strikes in the strike counter is equal to the threshold (for example only, three) at 712, the control module 22 modifies the control algorithm at 716. For example, the control module 22 may modify the control algorithm by increasing the run time at low capacity by a predetermined time, such as by five minutes. Thus, instead of commanding a runtime of 20 minutes and if the compressor demand is still present, switching the compressor to a high stage until the compressor demand is met, the control module 22 will command a run time of 25 minutes and if the compressor demand is still present, the control module 22 will then switch the compressor to a high stage until the compressor demand is met.

At 720, the control module 22 resets the strike counter to zero. At 704, the method 600 ends.

Returning to 688, if the difference is not within the third predetermined range, the control module 22 determines whether the difference is within a fourth predetermined range at 724. For example only, the fourth predetermined range may be between −10 and 0° F. If the difference is not within the fourth predetermined range, the control module proceeds with regular operation at 700. For example, regular operation may be commanding a runtime of 20 minutes and if the compressor demand is still present, switching the compressor to a high stage until the compressor demand is met. The method 600 then ends at 704.

If the difference is within the fourth predetermined range at 724, the control module 22 begins an observation period at 728. During the observation period, the control module 22 monitors the cycle runtimes. At 732, the control module 22 determines whether the runtimes for a predetermined number of low compressor cycles is less than or equal to a runtime threshold. For example only, the runtime threshold may be 40 minutes/cycle and the predetermined number of low compressor cycles may be two. The two compressor cycles may be consecutive cycles or may be two compressor cycles out of a predetermined number, such as three. For example, if the compressor cycles from off to low stage (for at least 40 minutes) to off twice, the threshold at 732 may be met.

If the runtimes for the predetermined number of low compressor cycles is not less than or equal to the runtime threshold, the control module 22 proceeds with regular operation at 700. For example, regular operation may be commanding a runtime of 20 minutes and if the compressor demand is still present, switching the compressor to a high stage until the compressor demand is met. The method 600 then ends at 704.

If the runtimes for the predetermined number of low compressor cycles is less than or equal to the runtime threshold at 732, the control module 22 adds a reverse strike to a reverse strike counter at 736. If the number of reverse strikes in the reverse strike counter is less than a threshold (for example only, two) at 740, the method 600 returns to 732. If the number of reverse strikes in the reverse strike counter is equal to the threshold (for example only, two) at 740, the control module 22 modifies the control algorithm at 744. For example, the control module 22 may modify the control algorithm by decreasing the run time at low capacity by a predetermined time, such as by five minutes. Thus, instead of commanding a runtime of 20 minutes and if the compressor demand is still present, switching the compressor to a high stage until the compressor demand is met, the control module 22 will command a run time of 15 minutes and if the compressor demand is still present, the control module 22 will then switch the compressor to a high stage until the compressor demand is met.

At 748, the control module 22 resets the reverse strike counter to zero. At 704, the method 600 ends.

Figure 17:
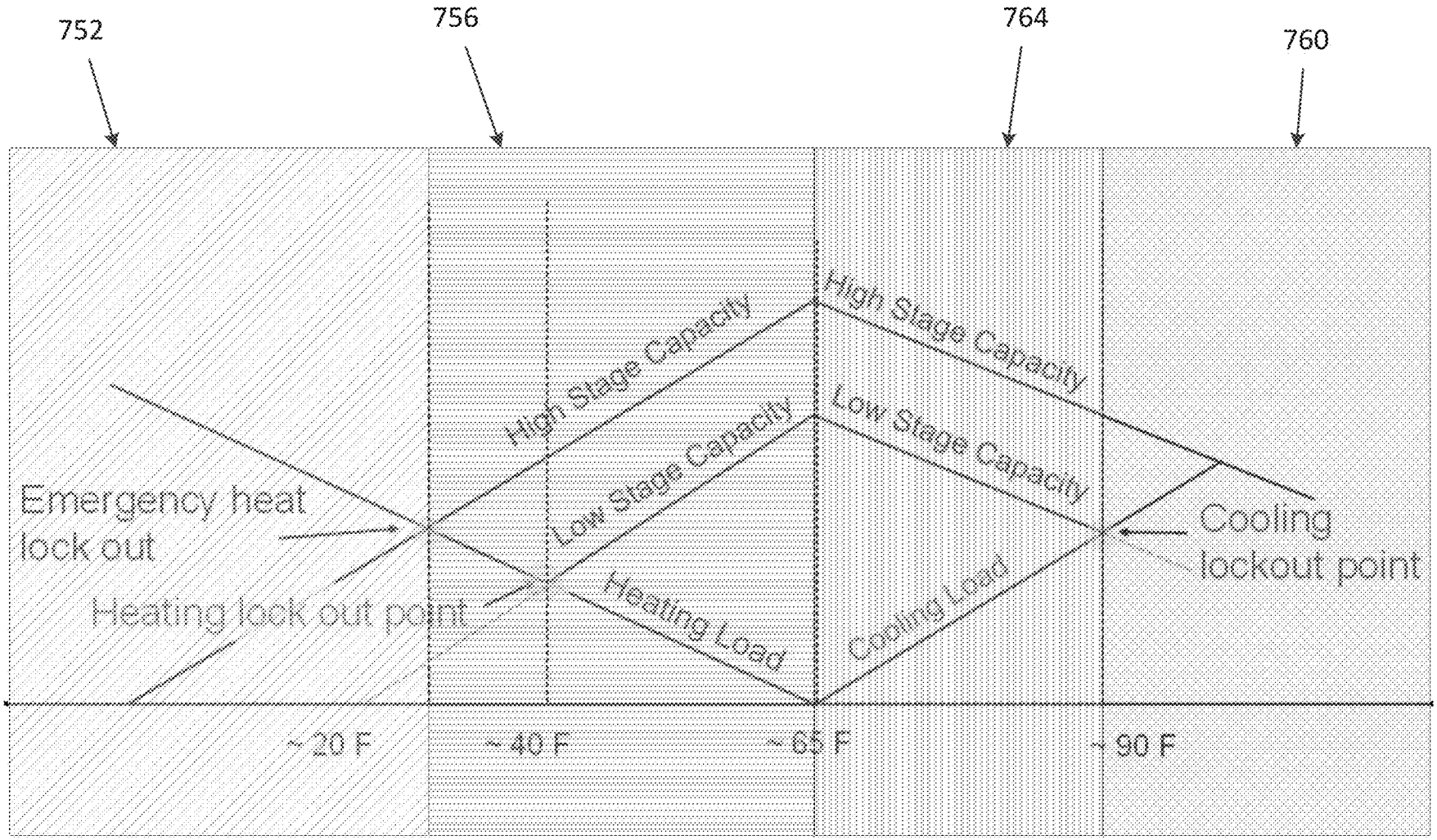
FIG. 17 is a graph of the example control strategy of FIGS. 15-16 incorporating heating and cooling lockout points.

Now referring to FIG. 17, the method 600 of FIGS. 15-16 monitors the shaded areas displayed in the graph. The heating cycle (FIG. 15) portion of the method 600 focuses on the shaded blocks 752 and 756, and the cooling cycle (FIG. 16) portion of the method 600 focuses on the shaded blocks 760 and 764. The shaded block 752 includes the temperatures below the emergency heat lockout point (for example only, 30° F.) and is representative of the portion of the method 600 in references 620-652 (FIG. 15). The shaded block 756 includes the temperatures from the heat lockout point to the outdoor ambient temperature threshold (referenced in 616—for example only, 65° F.) and is representative of the portion of the method 600 in references 656-680 (FIG. 15). The shaded block 760 includes the temperatures higher than the cooling lockout point (for example only, 90° F.) and is representative of the portion of the method 600 in references 688-720 (FIG. 16). The shaded block 764 includes the temperatures from the cooling lockout point to the outdoor ambient temperature threshold (referenced in 616—for example only, 65° F.) and is representative of the portion of the method 600 in references 724-748 (FIG. 16). Thus, the method 600 covers the entire range in temperatures.

In the embodiments described in relation to FIGS. 6-17, the example tables start in low stage or low capacity and then proceed to high stage or high capacity. In alternative embodiments, the tables could start at high stage or high capacity and then switch to low stage or low capacity after a predetermined amount of time. The predetermined amount of time may be based on outdoor ambient temperature. An example table starting at high stage or high capacity and then switching to low stage or low capacity after a predetermined amount of time is provided in FIG. 18.

For example, in FIG. 18, run times for different outdoor ambient temperatures is provided, along with a cooling lockout adjustment column (since only the cooling season is shown). In this case, a balance point can be detected based on the run time in the high stage. If the high stage run time for the last threshold number of cycles (for example only, three cycles) was less than a predetermined time threshold (for example only, 15 minutes), the control module 22 may reduce the high stage run time by a provided number of minutes (for example only, 10 minutes).

Now referring to FIGS. 19-22, in alternative embodiments, the control module 22 may control auxiliary heating (i.e., turning an auxiliary heater OFF and ON). In these embodiments, the control module 22 may delay or stop the auxiliary heat from turning ON in the first few minutes of a compressor cycle when the outdoor ambient temperature is within a predetermined range (i.e., not extremely cold).

Typically, the auxiliary heat or emergency heat turns ON after the climate-control system is unable to reach or meet a temperature setpoint in heating mode, after a predetermined run time. In the alternative embodiment, however, the control module 22 checks the outdoor ambient temperature and if the outdoor ambient temperature is less than a predetermined threshold (for example only, less than the heating lockout), the control module 22 allows the auxiliary heat to turn ON after a predetermined compressor run time in high stage. If the outdoor ambient temperature meets or exceeds the predetermined threshold (for example only, the heating lockout), the control module 22 waits for a predetermined amount of run time (for example only, 30 minutes), and then turns on the auxiliary heat. If, during the compressor cycle, the outdoor ambient temperature falls below the heating lockout point, the control module 22 allows the auxiliary heater to be turned ON after a preset number of minutes of total compressor run time. Furthermore, if the compressor is running in low stage, the control module 22 switches the compressor 12 to high stage and allows a preset run time to surpass before allowing the auxiliary heater to turn ON.

Figure 19:
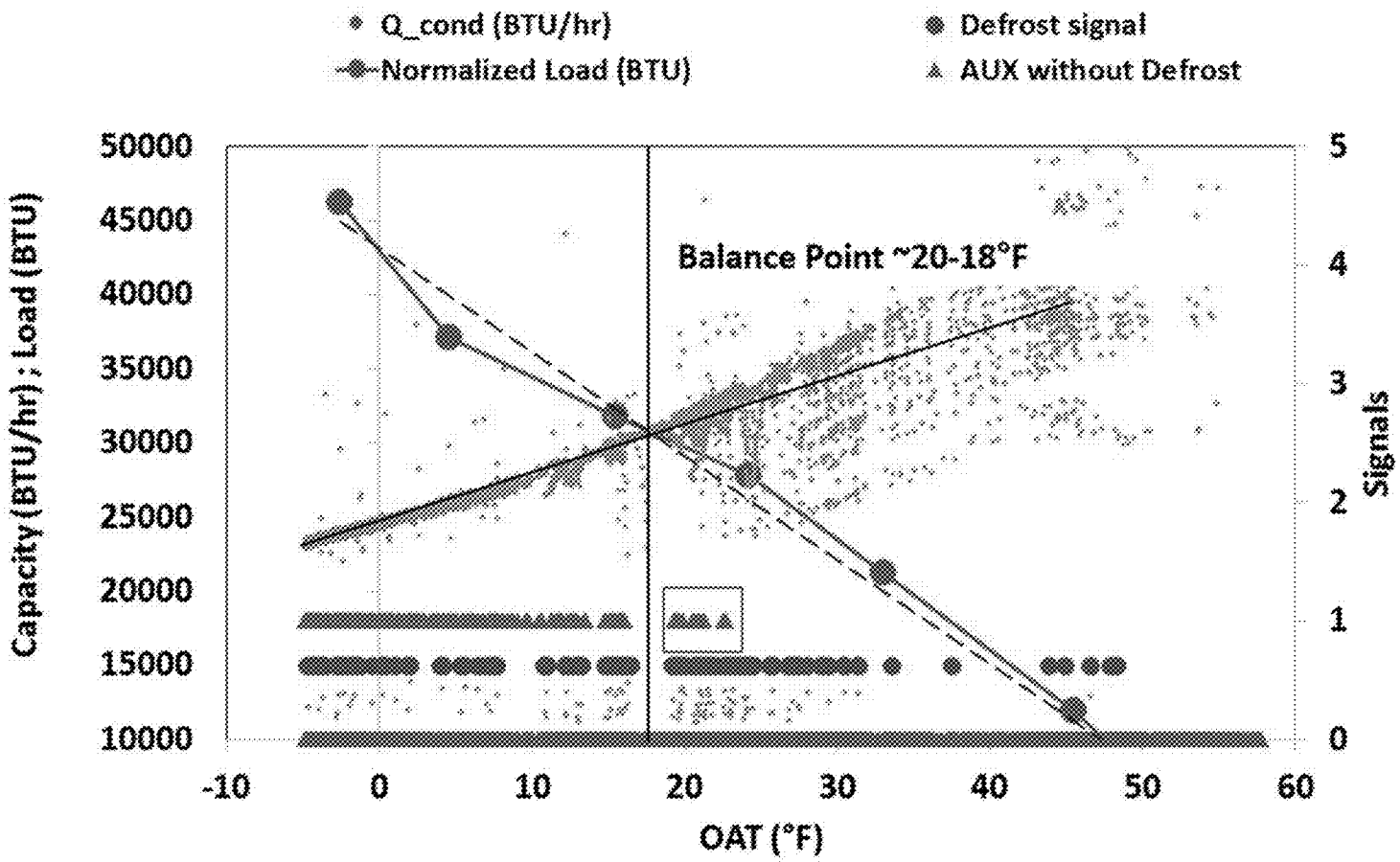
FIG. 19 is a graph illustrating a relationship between demand, load, defrost signal, and auxiliary heat signal.

FIG. 19 illustrates a relationship between the heating capacity, the demand, the normalized load, the auxiliary heat signal, and the defrost signal, as a function of the outdoor ambient temperature. The demand is shown as dots trending in an upward direction as outdoor ambient temperature increases. At temperatures to the right of the normalized load line, the demand points become more dispersed because the system turns on/off or cycles and also modulates between higher and lower compression capacity. As shown in the graph, when the balance point is set to approximately 18 to 20° F., the auxiliary heat (without defrost) is turned ON less frequently as the outdoor ambient temperature increases, the demand increases, and the normalized load decreases.

Figure 20:
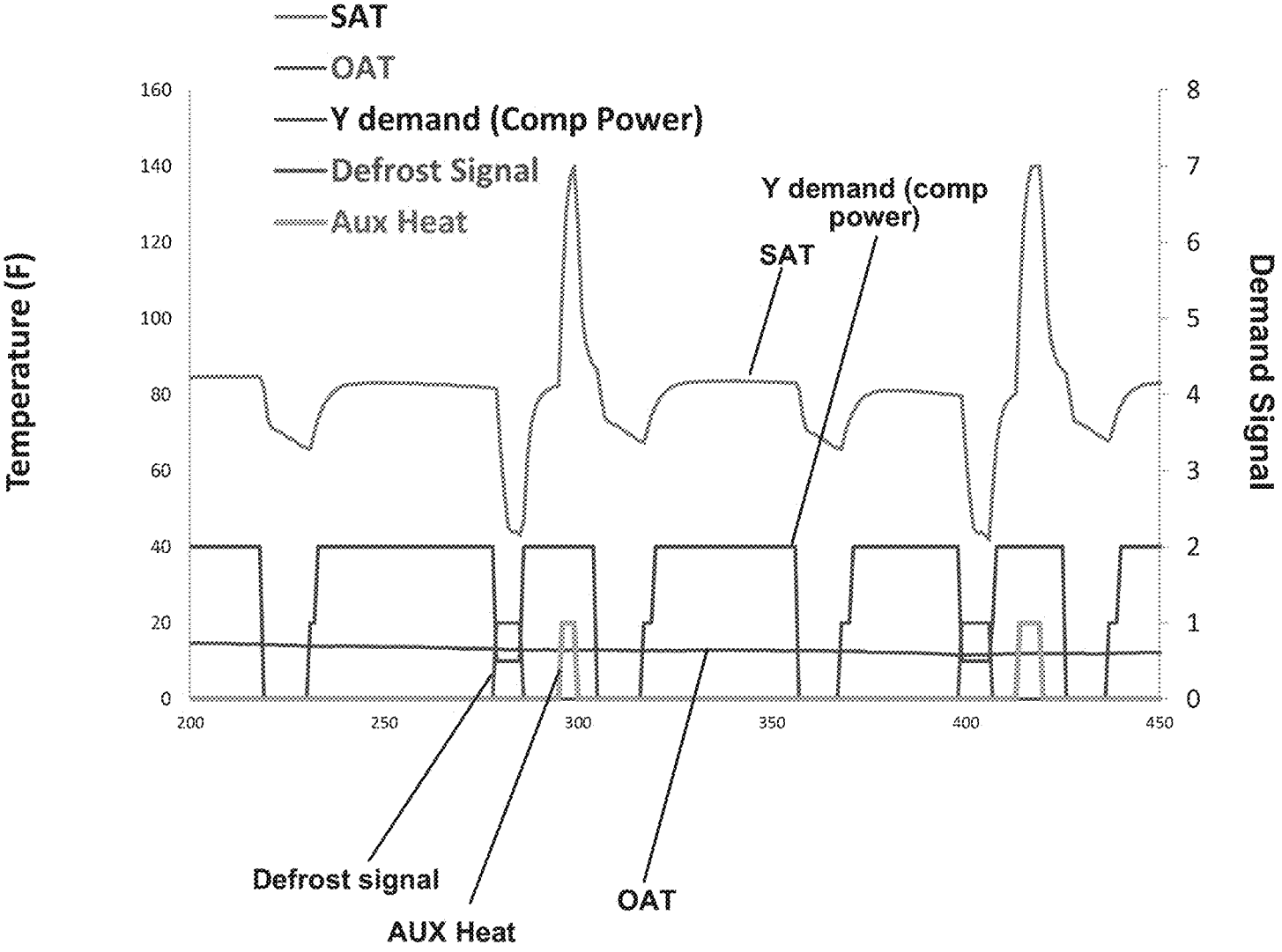
FIG. 20 is a graph illustrating a relationship between supply air temperature, outdoor ambient temperature, demand, defrost signal, and auxiliary heat signal.

Now referring to FIG. 20, relationships between the supply air temperature, outdoor air temperature, demand, defrost signal, and auxiliary heat are illustrated. Excessive auxiliary heat causes the temperature to meet the thermostat setpoint temperature and the system shuts down prematurely. The system could have met the thermostat setpoint temperature with additional run time and without the use of the auxiliary heat. As further explained below, the control module 22 may detect this condition and prevent the auxiliary heat from turning ON in this period by taking into account the outdoor ambient temperature and run time.

Figure 21:
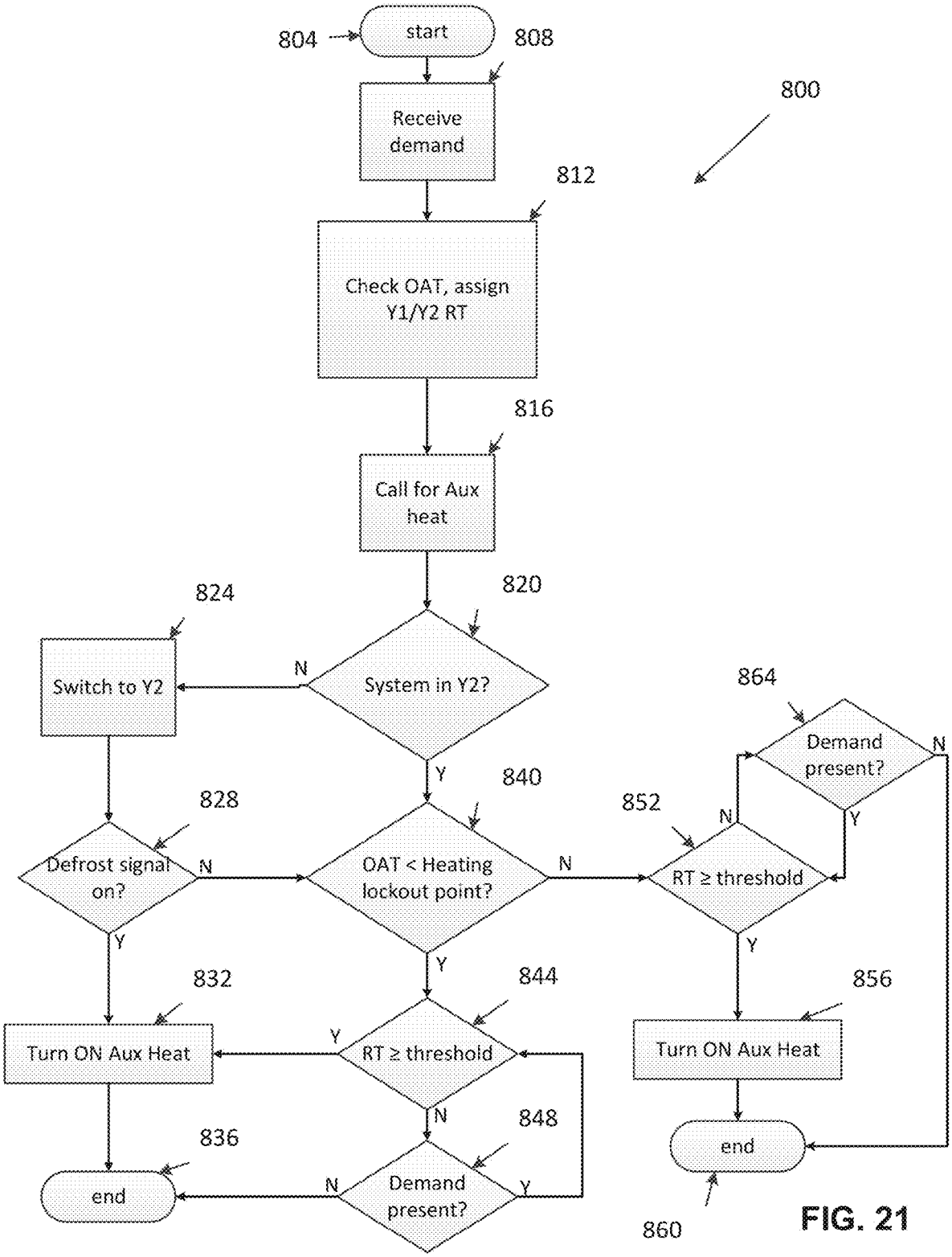
FIG. 21 is a flowchart of a method for controlling an auxiliary heater 21 according to the present disclosure.

Referring to FIG. 21, a method 800 for controlling an auxiliary heater 21 is illustrated. Method 800 may be performed by control module 22 in conjunction with the outdoor ambient temperature sensor 24, the thermostat 26, the compressor 12, and the auxiliary heater 21. Method 800 begins at 804. At 808, the control module 22 receives a compressor capacity demand. The compressor demand may be sent as a signal from the thermostat 26.

At 812, the control module 22 receives the outdoor ambient temperature and assigns the high stage and low stage run times. For example, the outdoor ambient temperature may be received from the outdoor ambient temperature sensor 24. Additionally, the control module 22 may command the compressor 12 to a low stage or a high stage based on the outdoor ambient temperature. For example, if the outdoor ambient temperature is 75° F., the control module 22 may command the compressor 12 to run at a low capacity stage for 20 minutes. If the demand is still present after 20 minutes, the control module 22 may command the compressor 12 to run at a high capacity stage.

At 816, the control module 22 receives a demand for auxiliary heat. The demand signal may come from the thermostat 26 and may come after the system is unable to reach the setpoint temperature in heating mode in a predetermined amount of time (for example only, 30 minutes).

At 820, the control module 22 determines whether the compressor 12 is operating at high stage. If the compressor 12 is not operating at high stage, the control module 22 commands the compressor 12 to high stage at 824. At 828, the control module 22 determines whether the defrost signal is on. The defrost signal may be sent by the control module which may be located in the outdoor unit of a residential split HVAC unit.

If the defrost signal is on, the control module 22 commands the auxiliary heater 21 to turn ON at 832. The method 800 then ends at 836.

Returning to 828, if the defrost signal is not on, the control module 22 determines whether the outdoor ambient temperature is less than the heating lockout point at 840. The method 800 will also move to 840 if the controller 12 is operating at high stage at 820. As previously stated, in some climate-control configurations, the heating lockout point may be set to 40° F. As such, the compressor is locked in high stage once the ambient temperature reaches 40° F. or lower. In other configurations, the heating lockout point may be set to a different temperature, such as 30° F.

If the outdoor ambient temperature is less than the heating lockout point, the control module 22 determines whether the compressor 12 has exceeded a threshold predetermined run time (for example only, 20 minutes) at 844. If true, the control module 22 commands the auxiliary heater 21 to turn ON at 832. The method 800 then ends at 836.

If false at 844, the control module 22 determines whether the demand is present at 848. The demand may be sent as a signal from the thermostat 26. If the demand is present, the method 800 returns to 844. If the demand is no longer present at 848, the method 800 ends at 836.

Returning to 840, if the outdoor ambient temperature is not less than the heating lockout point, the control module 22 determines whether the compressor 12 has exceeded a threshold predetermined run time (for example only, 60 minutes) at 852. If true, the control module 22 commands the auxiliary heater 21 to turn ON at 856. The method 800 then ends at 860.

If false at 852, the control module 22 determines whether the demand is present at 864. The demand may be sent as a signal from the thermostat 26. If the demand is present, the method 800 returns to 852. If the demand is no longer present at 864, the method 800 ends at 860.

Figure 22:
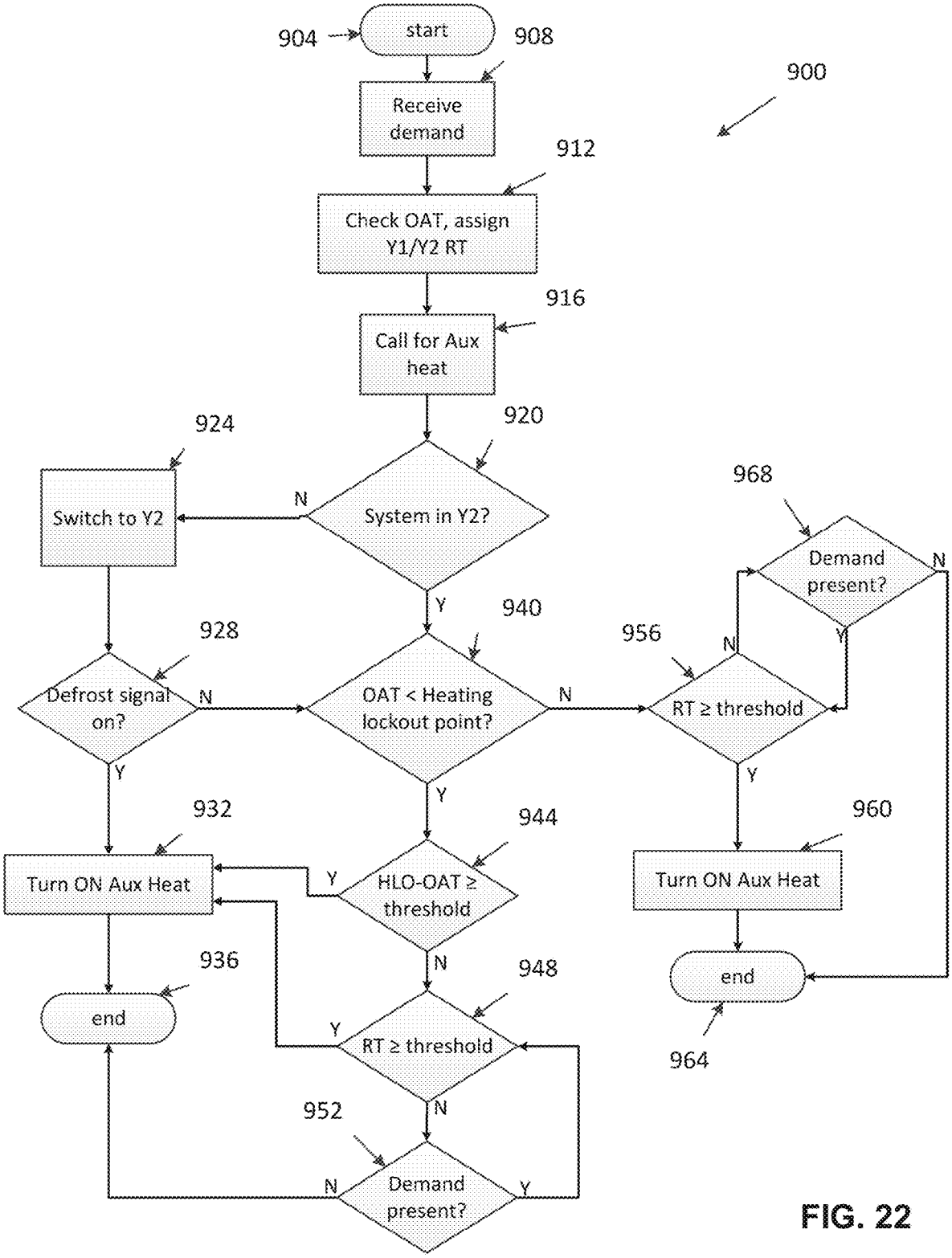
FIG. 22 is a flowchart of another method for controlling an auxiliary heater according to the present disclosure.

Now referring to FIG. 22, a method 900 for controlling an auxiliary heater 21 is illustrated. Method 900 may be performed by control module 22 in conjunction with the outdoor ambient temperature sensor 24, the thermostat 26, the compressor 12, and the auxiliary heater 21. Method 900 begins at 904. At 908, the control module 22 receives a compressor capacity demand. The compressor demand may be sent as a signal from the thermostat 26.

At 912, the control module 22 receives the outdoor ambient temperature and assigns the high stage and low stage run times. For example, the outdoor ambient temperature may be received from the outdoor ambient temperature sensor 24. Additionally, the control module 22 may command the compressor 12 to a low stage or a high stage based on the outdoor ambient temperature. For example, if the outdoor ambient temperature is 75° F., the control module 22 may command the compressor 12 to run at a low capacity stage for 20 minutes. If the demand is still present after 20 minutes, the control module 22 may command the compressor 12 to run at a high capacity stage.

At 916, the control module 22 receives a demand for auxiliary heat. The demand signal may come from the thermostat 26 and may come after the system is unable to reach the setpoint temperature in heating mode in a predetermined amount of time (for example only, 30 minutes).

At 920, the control module 22 determines whether the compressor 12 is operating at high stage. If the compressor 12 is not operating at high stage, the control module 22 commands the compressor 12 to high stage at 924. At 928, the control module 22 determines whether the defrost signal is on. The defrost signal may be sent by the control module which may be located in the outdoor unit of a residential split HVAC unit.

If the defrost signal is on, the control module 22 commands the auxiliary heater 21 to turn ON at 932. The method 900 then ends at 936.

Returning to 928, if the defrost signal is not on, the control module 22 determines whether the outdoor ambient temperature is less than the heating lockout point at 940. The method 900 will also move to 940 if the controller 12 is operating at high stage at 920. As previously stated, in some climate-control configurations, the heating lockout point may be set to 40° F. As such, the compressor is locked in high stage once the ambient temperature reaches 40° F. or lower. In other configurations, the heating lockout point may be set to a different temperature, such as 30° F.

If the outdoor ambient temperature is less than the heating lockout point at 940, the control module 22 determines whether the difference between the heating lockout point and the outdoor ambient temperature is greater than or equal to a threshold (for example only, 10° F.) at 944. For example, the difference may be determined by subtracting the outdoor ambient temperature from the heating lockout point.

If true at 944, the control module 22 commands the auxiliary heater 21 to turn ON at 932. The method 900 then ends at 936. If false at 944, the control module 22 determines whether the compressor 12 has exceeded a threshold predetermined run time (for example only, 20 minutes) at 948.

If the compressor 12 has exceeded the predetermined run time, the control module 22 commands the auxiliary heater 21 to turn ON at 932. The method 900 then ends at 936.

If the compressor 12 has not exceeded the threshold predetermined run time at 948, the control module 22 determines whether the demand is present at 952. The demand may be sent as a signal from the thermostat 26. If the demand is present, the method 900 returns to 948. If the demand is no longer present at 952, the method 900 ends at 936.

Returning to 940, if the outdoor ambient temperature is not less than the heating lockout point, the control module 22 determines whether the compressor 12 has exceeded a threshold predetermined run time (for example only, 60 minutes) at 956. If true, the control module 22 commands the auxiliary heater 21 to turn ON at 960. The method 900 then ends at 964.

If false at 956, the control module 22 determines whether the demand is present at 968. The demand may be sent as a signal from the thermostat 26. If the demand is present, the method 900 returns to 956. If the demand is no longer present at 968, the method 900 ends at 964.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A climate-control system comprising:

a variable-capacity compressor;

an outdoor ambient temperature sensor indicating a temperature of outdoor ambient air;

a user-controlled device providing a demand signal indicating a demand for at least one of heating and cooling; and a control module commanding a compressor stage and a stage run time based on the temperature from the outdoor ambient temperature sensor and the demand signal, wherein the control module commands the compressor to high stage if the temperature from the outdoor ambient temperature sensor is outside of a lockout threshold;

the control module modifies the lockout threshold based on a cycle run time, and the cycle run time is an actual run time for the compressor to meet a setpoint temperature.

2. The climate-control system of claim 1, the control module increases a strike counter when the cycle run time for the last three cycles is less than fifteen minutes per cycle and a difference between the outdoor ambient temperature and a heating lockout temperature is within a predetermined range.

3. The climate-control system of claim 2, wherein the control module modifies the lockout threshold when the strike counter reaches three strikes.

4. The climate-control system of claim 3, wherein the lockout threshold is a heating lockout threshold, and the control module modifies the heating lockout threshold by adding a heating lockout adjustment column to a run time column in a run time table.

5. The climate-control system of claim 3, wherein the lockout threshold is a heating lockout threshold, and the control module modifies the heating lockout threshold by adding ten minutes to a run time at the heating lockout threshold.

6. The climate-control system of claim 1, the control module increases a strike counter when the cycle run time for the last three cycles is at least fifteen minutes per cycle and a difference between the outdoor ambient temperature and a cooling lockout temperature is within a predetermined range.

7. The climate-control system of claim 6, wherein the control module modifies the lockout threshold when the strike counter reaches three strikes.

8. The climate-control system of claim 7, wherein the lockout threshold is a cooling lockout threshold, and the control module modifies the cooling lockout threshold by adding a cooling lockout adjustment column to a run time column in a run time table.

9. The climate-control system of claim 7, wherein the lockout threshold is a cooling lockout threshold, and the control module modifies the cooling lockout threshold by adding ten minutes to a run time at the cooling lockout threshold.

10. The climate-control system of claim 1, the control module increases a reverse strike counter when the cycle run time for the last two cycles is at least forty minutes per cycle and a difference between the outdoor ambient temperature and a heating lockout temperature is within a predetermined range.

11. The climate-control system of claim 10, wherein the control module modifies the lockout threshold when the reverse strike counter reaches two strikes.

12. The climate-control system of claim 11, wherein the lockout threshold is a heating lockout threshold, and the control module modifies the heating lockout threshold by subtracting a heating lockout adjustment column from a run time column in a run time table.

13. The climate-control system of claim 11, wherein the lockout threshold is a heating lockout threshold, and the control module modifies the heating lockout threshold by subtracting ten minutes from a run time at the heating lockout threshold.

14. The climate-control system of claim 1, the control module increases a reverse strike counter when the cycle run time for the last two cycles is at least forty minutes per cycle and a difference between the outdoor ambient temperature and a cooling lockout temperature is within a predetermined range.

15. The climate-control system of claim 14, wherein the control module modifies the lockout threshold when the reverse strike counter reaches two strikes.

16. The climate-control system of claim 15, wherein the lockout threshold is a cooling lockout threshold, and the control module modifies the cooling lockout threshold by subtracting a cooling lockout adjustment column from a run time column in a run time table.

17. The climate-control system of claim 15, wherein the lockout threshold is a cooling lockout threshold, and the control module modifies the cooling lockout threshold by subtracting ten minutes from a run time at the cooling lockout threshold.

18. The climate-control system of claim 1, wherein the user-controlled device is a thermostat.

19. The climate-control system of claim 1, wherein the user-controlled device is an application on a mobile device.

20. The climate-control system of claim 1, further comprising an auxiliary heater.

21. The climate-control system of claim 20, wherein the control module selectively enables the auxiliary heater based on at least one of the compressor stage, the outdoor ambient temperature, the lockout threshold, and the cycle run time.

22. The climate-control system of claim 21, wherein the control module enables the auxiliary heater if the compressor is running in high stage and a defrost signal is enabled.

23. The climate-control system of claim 21, wherein the control module enables the auxiliary heater if the cycle run time is greater than sixty minutes.

24. The climate-control system of claim 21, wherein the control module enables the auxiliary heater if the outdoor ambient temperature is less than the lockout threshold and the cycle run time is greater than twenty minutes.

25. A method for controlling a climate-control system having a variable-capacity compressor, the method comprising:

Indicating, by an outdoor ambient temperature sensor, a temperature of outdoor ambient air;

receiving, from a user-controlled device, a demand signal indicating a demand for at least one of heating and cooling;

commanding, by a control module, a compressor stage and a stage run time based on the temperature from the outdoor ambient temperature sensor and the demand signal;

commanding, by the control module, the compressor to a high stage if the temperature from the outdoor ambient temperature sensor is outside of a lockout threshold; and modifying, by the control module, the lockout threshold based on a cycle run time, wherein the cycle run time is an actual run time for the compressor to meet a setpoint temperature.

* * * * *